US010886059B2

(12) United States Patent
Otsubo et al.

(10) Patent No.: US 10,886,059 B2
(45) Date of Patent: Jan. 5, 2021

(54) COIL COMPONENT

(71) Applicant: MURATA MANUFACTURING CO., LTD., Kyoto (JP)

(72) Inventors: Yoshihito Otsubo, Kyoto (JP); Junji Kurobe, Kyoto (JP); Norio Sakai, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 1064 days.

(21) Appl. No.: 15/371,305

(22) Filed: Dec. 7, 2016

(65) Prior Publication Data

US 2017/0084384 A1 Mar. 23, 2017

Related U.S. Application Data

(63) Continuation of application No. PCT/JP2015/064170, filed on May 18, 2015.

(30) Foreign Application Priority Data

Jun. 11, 2014 (JP) ..... 2014-120173
Aug. 29, 2014 (JP) ..... 2014-175384

(51) Int. Cl.
*H01F 27/29* (2006.01)
*H01F 17/06* (2006.01)
(Continued)

(52) U.S. Cl.
CPC ..... *H01F 27/29* (2013.01); *H01F 17/0013* (2013.01); *H01F 17/0033* (2013.01);
(Continued)

(58) Field of Classification Search
CPC ..... H01F 27/29; H01F 27/2804; H01F 27/24; H01F 17/0013; H01F 17/0033; H01F 17/06; H01F 2027/2809
(Continued)

(56) References Cited

U.S. PATENT DOCUMENTS 5,635,669 A * 6/1997 Kubota ..... H01G 2/065 174/524
5,781,091 A * 7/1998 Krone ..... H01F 17/0033 336/200
(Continued)

FOREIGN PATENT DOCUMENTS

JP S553232 U 1/1980
JP 2003-309012 A 10/2003
(Continued)

OTHER PUBLICATIONS

International Search Report issued in Japanese Patent Application No. PCT/JP2015/064170 dated Jun. 23, 2015.
(Continued)

*Primary Examiner* — Tszfung J Chan
(74) *Attorney, Agent, or Firm* — Pearne & Gordon LLP

(57) ABSTRACT

A coil component 1*a* includes an insulation layer 2 in which a magnetic body core 3 is embedded; a coil electrode 4 wound around the magnetic body core 3; and an input metal pin 5*a* and an output metal pin 5*b* for external connection whose lower end surfaces are respectively provided being exposed from the insulation layer 2 in a state of the input and output metal pins 5*a* and 5*b* being provided upright in a thickness direction of the insulation layer 2. The coil electrode 4 includes a plurality of coil metal pins 4*a* and 4*b* that are arranged around the magnetic body core 3 in a state of being provided upright in the thickness direction of the insulation layer 2, and the input metal pin 5*a* and the output metal pin 5*b* are formed to be larger in diameter than the coil metal pins 4*a* and 4*b*.

21 Claims, 15 Drawing Sheets

(51) Int. Cl.
*H01F 17/00* (2006.01)
*H01F 27/24* (2006.01)
*H01F 27/28* (2006.01)

(52) U.S. Cl.
CPC ..... *H01F 17/06* (2013.01); *H01F 27/24* (2013.01); *H01F 27/2804* (2013.01)

(58) Field of Classification Search
USPC ..... 336/200, 232
See application file for complete search history.

(56) References Cited

U.S. PATENT DOCUMENTS

2002/0097132 A1* 7/2002 Ahn ..... H01F 17/0033 336/221
2002/0153987 A1* 10/2002 Horie ..... H01F 17/0013 336/200
2009/0002111 A1 1/2009 Harrison et al.
2009/0175014 A1* 7/2009 Zeng ..... H01F 27/29 361/782
2015/0200050 A1* 7/2015 Nakao ..... H01F 41/22 336/200
2016/0035481 A1* 2/2016 Hachiya ..... H01F 27/2804 336/61

FOREIGN PATENT DOCUMENTS

JP 2003309012 A * 10/2003
JP 2007-096249 A 4/2007
JP 2010-516056 A 5/2010

OTHER PUBLICATIONS

Written Opinion issued in Japanese Patent Application No. PCT/JP2015/064170 dated Jun. 23, 2015.

* cited by examiner

COIL COMPONENT

This is a continuation of International Application No. PCT/JP2015/064170 filed on May 18, 2015 which claims priority from Japanese Patent Application No. 2014-175384 filed on Aug. 29, 2014 and Japanese Patent Application No. 2014-120173 filed on Jun. 11, 2014. The contents of these applications are incorporated herein by reference in their entireties.

BACKGROUND OF THE DISCLOSURE

Field of the Disclosure

The present disclosure relates to a coil component that includes an insulation layer in which a coil core is embedded and a coil electrode wound around the coil core, and is connected to the exterior.

Description of the Related Art

Modules in which a coil component is mounted on a wiring substrate have been known. For example, as shown in FIG. 25, a module 100 disclosed in Patent Document 1 is a noise filter in which a plurality of capacitors 102 and a coil component 103 are mounted on a wiring substrate 101, and the coil component 103 is constituted of a plurality of wiring conductors formed on a mounting surface of the wiring substrate 101, a plurality of belt-like conductors 105 formed on an outer surface of an insulation cover 104, and a toroidal coil 106. In this case, the insulation cover 104 is formed in a double cylinder body with its bottom surface open while having a ring-like space for disposing the toroidal core 106. A plurality of pin terminal portions 107 are provided being projected on respective end surfaces of an inner circumference edge and an outer circumference edge of an opening end surface of the insulation cover 104 at substantially equal intervals. Further, these pin terminal portions 107 are so provided as to form a plurality of pairs on the inner circumference edge and on the outer circumference edge, and the pin terminal portions 107 in each pair are connected to each other with the band-like conductor 105. Through-holes 108 are formed at both ends of each wiring conductor formed on the wiring substrate 101, and the pin terminal portions 107 are inserted into respective predetermined through-holes 108, thereby forming two coil conductors respectively wound around the toroidal core 106.

Patent Document 1: Japanese Unexamined Utility Model Registration Application Publication No. 5-53232 (see paragraph [0007], FIG. 1, and so on)

BRIEF SUMMARY OF THE DISCLOSURE

With electronic apparatuses being miniaturized these days, coil components are required to be small in size and excellent in performance. In this case, for example, it can be considered to realize a higher inductance of a coil component by increasing the number of turns of the coil without changing the size of the coil component. However, in the known module 100, it is necessary to insert the pin terminal portions 107 into the through-holes 108 at the time of mounting the coil component 103 on the wiring substrate 101. This makes it difficult to mount the coil component 103 in such a case that the diameter of the pint terminal portion 107 becomes small or the number of the pin terminal portions 107 is increased. In particular, in the case where a structure in which an input pin terminal portion and an output pin terminal portion are provided in the coil component so as for the coil component to be connected to and mounted on an external motherboard or the like is employed, there arises a problem that it is difficult to mount the coil component on an external motherboard or the like if it is attempted to shorten the diameter of the input pin terminal portion and the output pin terminal portion, increase the total number of the stated pin terminal portions, and so on in the manner as discussed above.

The present disclosure has been conceived in consideration of the above problem, and an object of the disclosure is to provide a coil component capable of improving coil characteristics and raising mountability of the coil component to the exterior.

In order to accomplish the above object, a coil component according to the present disclosure includes an insulation layer in which a coil core is embedded; a coil electrode wound around the coil core; an input conductor for external connection which has at least one input metal pin and is embedded in the insulation layer in a state of part of the input conductor being exposed; and an output conductor which has at least one output metal pin and is embedded in the insulation layer in a state of part of the output conductor being exposed. The coil electrode includes a plurality of coil metal pins that are arranged around the coil core in a state of being provided upright in a thickness direction of the insulation layer; in a state in which the input metal pin and the output metal pin are provided upright in the thickness direction of the insulation layer, at least one of part of a circumference side surface and one end surface of each of the input and output metal pins is provided being exposed from the insulation layer; and at least one of cross-section areas of the input conductor and the output conductor is wider than a cross-section area of the coil metal pin.

In this case, the coil electrode includes the plurality of coil metal pins that are arranged around the coil core in a state of being provided upright in the thickness direction of the insulation layer. In the case of the metal pin, in comparison with a via conductor formed by filling a conductive paste into a through-hole passing through in the thickness direction of the insulation layer, a through-hole conductor formed by plating a wall surface of the through-hole, or the like, characteristics of the coil component can be improved because resistance of the metal pin can be lowered even if the metal pin has the same conductor size as the via conductor, the through-hole conductor, or the like.

In the case of the via conductor, the through-hole conductor, or the like that needs the formation of a through-hole, it is necessary to set a predetermined interval between mutually adjacent conductors in order to form independent through-holes. This limits the increasing of the number of turns of the coil by shortening a gap between the mutually adjacent conductors. In contrast, in the case of the metal pin in which a through-hole is not formed, because a gap between mutually adjacent metal pins can be shortened with ease, it is possible to increase the number of turns of the coil electrode and improve coil characteristics (realization of a higher inductance) with ease. In addition, because at least one of the cross-section areas of the input conductor and the output conductor is formed to be wider than the cross-section area of the coil metal pin, a connection surface with the exterior can be easily widened in comparison with a case in which the input and output conductors are made of metal pins having the same diameter size as the coil metal pin, and one end surface of the conductor is made to function as a connection surface with the exterior. As such, reliability in connection with the exterior can be raised while improving coil characteristics of the coil electrode.

The input conductor may be formed of the single input metal pin, the output conductor may be formed of the single output metal pin, and at least one of the input metal pin and the output metal pin may be formed to be larger in diameter than the coil metal pins.

In this case, at least one of part of the circumference side surface and the one end surface of the input metal pin and the output metal pin, which are exposed from the insulation layer, functions as a connection surface with the exterior. For example, in the case where the input metal pin and the output metal pin are formed to have the same diameter size as the coil metal pins, when the diameter size of each of the coil metal pins is made smaller in order to increase the number of turns of the coil electrode, the diameter size of each of the input and output metal pins also becomes smaller, and consequently the connection surface with the exterior becomes smaller, thereby degrading the mountability of the coil component. As such, by forming at least one of the input and output metal pins to be larger in diameter than the coil metal pins, the connection surface with the exterior can be easily widened. This makes it possible to raise the mountability of the coil component while improving the coil characteristics by increasing the number of turns of the coil electrode.

Widening an exposed surface of the input and output metal pins from the insulation layer makes it possible to enlarge a connection area with the exterior so as to raise connection strength as well. In the case where part of the circumference side surface of the input and output metal pins is exposed and is made to serve as a connection surface with the exterior, visual inspection can be easily performed on a connection portion with the exterior after having mounted the coil component on an external substrate or the like.

At least one of the input conductor and the output conductor may be formed of assemblage in which a plurality of input metal pins or output metal pins having the same diameter size as the coil metal pins are collected, and at least one of part of a circumference side surface and one end surface of the assemblage may be provided being exposed from the insulation layer. With this, the coil metal pins and the input and output conductors can be formed with the same metal pins, thereby making it possible to decrease the manufacturing cost of the coil component. Further, changing the arrangement of the input or output metal pins makes it possible to change the shape of the assemblage with ease.

A gap between at least one of the input and output conductors and the adjacent coil metal pins may be wider than a gap between the mutually adjacent metal pins. With this, even in the case where the connection surface with the exterior (exposed surface from the insulation layer) is enlarged by making the size of the input and output conductors larger, such a risk can be reduced that the coil metal pins and the input and output conductors adjacent to each other are short-circuited with solder used for the mounting, or the like.

Further, at least one of the input conductor and the output conductor may be arranged in a position further distanced from the coil core than a position of each of the coil metal pins. With this, because at least one of the input and output conductors can be distanced from the coil electrode, the input and output conductors arranged in a position distanced from the coil core can be prevented from making contact with the coil metal pins.

The coil component may further include a dummy metal pin for external connection that is provided upright in the thickness direction of the insulation layer and is not electrically connected to the coil electrode. In the case where the number of portions connected with the exterior is small, there arises a high risk that the coil component is slanted, shifted, and so on when mounted to the exterior. However, mounting failure can be reduced by providing the dummy metal pin to increase the number of connection portions with the exterior. In addition, because the connection area with the exterior is also increased, the connection strength with the exterior can be enhanced.

The dummy metal pin may be arranged in a position point-symmetric in plan view relative to one of the input and output conductors while taking the center of the insulation layer as a center of the symmetry. As discussed above, when the dummy metal pin and one of the input and output conductors are arranged to be point-symmetric in plan view while taking the center of the insulation layer as the center of the symmetry, the arrangement of the connection portions with the exterior is well-balanced, whereby mounting failure can be further reduced.

The part of the input conductor and the part of the output conductor may be exposed from a circumference side surface of the insulation layer, and part of a circumference side surface of the dummy metal pin may be exposed as well from the circumference side surface of the insulation layer. With this, mounting failure can be reduced due to the dummy metal pin and the visual inspection can be easily performed on the connection portions with the exterior.

A length of the input conductor, a length of the output conductor, and a length of the dummy metal pin may be formed to be shorter than a length of the coil metal pin. In general, the length of each of the coil metal pins forming part of the coil electrode is substantially the same as the thickness of the coil core. Accordingly, in the case where part of the input and output conductors and part of the dummy metal pin are exposed from the circumference side surface of the insulation layer to serve as side surface electrodes, the size thereof in the thickness direction of the insulation layer is excessively large in some case. In such a case, since the amount of solder used for external connection is large, there is a risk that a short circuit is caused by the solder between the mutually adjacent input and output conductors and between dummy metal pins. Here, the length of each of the input and output conductors and the length of the dummy metal pin are formed to be shorter than the length of the coil metal pins so as to optimize the size of the exposed surfaces in the thickness direction of the insulation layer. With this, because the amount of solder needed for the mounting can be reduced, even in the case where a pitch between the input and output conductors and a pitch between the dummy metal pins become smaller, the occurrence of a short circuit caused by the solder between the mutually adjacent metal pins or between the metal pin and the input and output conductors can be reduced.

A shape of the insulation layer in plan view, a shape of a cross-section of the input metal pin, and a shape of a cross-section of the output metal pin may be formed to be rectangular, and each of side surfaces of the input metal pin and the output metal pin exposed from the insulation layer may form the same plane surface along with a side surface of the insulation layer.

As a method in which each of the side surfaces of the input and output metal pins exposed from the insulation layer forms the same plane surface along with the side surface of the insulation layer, such a method can be cited that a dicing blade is made to penetrate the metal pins, which are provided upright and covered with the insulation layer, in the thickness direction of the insulation layer, and cut the metal pins in a lengthwise direction along with the insulation layer, for example. In this case, when the shape of the cross-section of the input and output conductors and the shape of the dummy metal pin are circular, an area of the side surface of each of the metal pins exposed from the insulation layer varies due to a shift in position of the dicing blade. Meanwhile, in the case where the shape of the cross-section of each of the metal pins is rectangular, even if the position of the dicing blade is shifted in parallel to one side of the rectangle of each of the metal pins, the amount of variation in the area of the exposed surface can be suppressed, whereby a variation in the area of the side surface of each of the metal pins exposed from the insulation layer can be reduced.

The shape of the insulation layer may be formed to be rectangular in plan view, the input or output metal pins included in the aforementioned assemblage may be aligned along a predetermined side of the insulation layer, and part of the circumference side surface of each of the input metal pins or part of the circumference side surface of each of the output metal pins may be exposed from the side surface of the insulation layer as a portion of the assemblage exposed from the insulation layer.

For example, in the case where each of the input and output conductors is formed with a single metal pin, it can be considered to make a cross-section area of the metal pin large in order to improve the connection strength with the exterior. In this case, when the input and output conductors are embedded in the insulation layer, a formation space for wiring electrodes or the like to be formed inside the insulation layer is restricted. On the other hand, in the aforementioned structure, because the input or output metal pins are aligned along a predetermined side of the insulation layer, a formation space for wiring electrodes or the like can be secured in an inner side portion region of the insulation layer while making the size of at least one of the input and output conductors larger.

According to the present disclosure, because the coil electrode includes a plurality of coil metal pins that are arranged around a coil core in a state of being provided upright in a thickness direction of an insulation layer, it is possible to shorten a gap between the coil metal pins and increase the number of turns of the coil, whereby characteristics of the coil component can be improved. In addition, because a cross-section area of at least one of the input and output conductors is formed to be larger than a cross-section area of each of the coil metal pins, an connection surface with the exterior can be enlarged, whereby mountability of the coil component can be raised while improving coil characteristics.

DETAILED DESCRIPTION OF THE DISCLOSURE

First Embodiment

Figure 1:
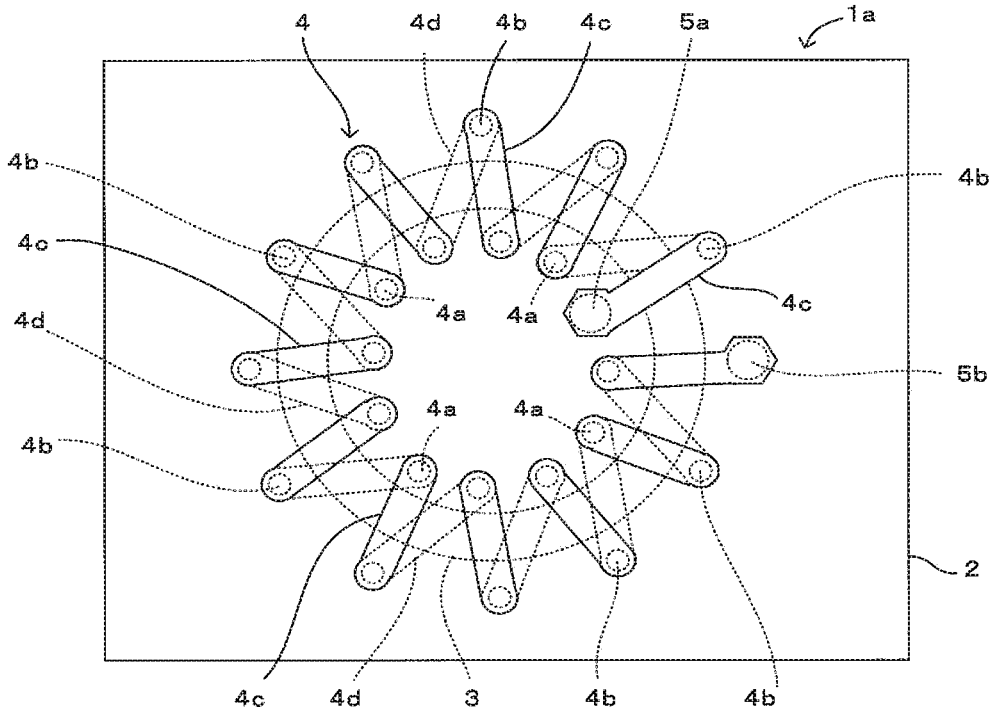
FIG. 1 is a plan view of a coil component according to a first embodiment of the present disclosure.

A coil component 1*a* according to a first embodiment of the present disclosure will be described with reference to FIG. 1. FIG. 1 is a plan view of the coil component 1*a*.

The coil component 1*a* according to the present embodiment includes, as shown in FIG. 1, an insulation layer 2 in which a magnetic body core 3 (corresponds to "coil core" of the present disclosure) is embedded, a coil electrode 4 wound around the magnetic body core 3, and an input metal pin 5*a* (corresponds to "input conductor" of the present disclosure) for external connection and an output metal pin 5*b* (corresponds to "output conductor" of the present disclosure) for external connection; one end surface of each of the input metal pin 5*a* and the output metal pin 5*b* is provided being exposed from the insulation layer 2 in a state of the input and output metal pins 5*a* and 5*b* being provided upright in a thickness direction of the insulation layer 2. The stated coil component 1*a* is mounted on an external motherboard or the like.

The insulation layer 2 is formed with a resin such as an epoxy resin or the like, for example, and is formed having a predetermined thickness so as to cover the magnetic body core 3, the input and output metal pins 5*a* and 5*b*, and a plurality of coil metal pins 4*a* and 4*b* which will be described later.

The magnetic body core 3 is formed with a magnetic material, such as Mn—Zn ferrite or the like, that is employed as a general coil core. The magnetic body core 3 of the present embodiment is formed in a ring shape, and is used as a core of a toroidal coil.

The coil electrode 4 is an electrode that is spirally wound around the ring-shaped magnetic core 3, and includes the plurality of coil metal pins 4*a* and 4*b* that are arranged around the magnetic body core 3 in a state of being provided upright in the thickness direction of the insulation layer 2. Each of the coil metal pins 4*a* and 4*b* is formed with a metallic material, such as Cu, Au, Ag, Al, a Cu-based alloy, or the like, that is generally employed as a wiring electrode. The coil metal pins 4*a* and 4*b* can be formed, for example, by shearing a wire rod made of one of the above-cited metallic materials.

Here, as shown in FIG. 1, the coil metal pins 4*a* and 4*b* are constituted of metal pins that are arranged along an inner circumference surface of the magnetic body core 3 (hereinafter referred to as inner side portion metal pins 4*a* in some cases) and metal pins that are arranged along an outer circumference surface of the magnetic body core 3 (hereinafter referred to as outer side portion metal pins 4*b* in some cases) so as to form a plurality of pairs in combination with the corresponding inner side portion metal pins 4*a*. At this time, both end surfaces of each of the inner side portion metal pins 4*a* and the outer side portion metal pins 4*b* are provided being exposed from main surfaces of the insulation layer 2.

Upper end surfaces of the paired inner side portion metal pin 4*a* and outer side portion metal pin 4*b* are respectively connected to one upper side portion wiring electrode pattern 4*c* formed on the upper surface of the insulation layer 2. Further, a lower end surface of the outer side portion metal pin 4*b* and a lower end surface of the inner side portion metal pin 4*a* adjacent to the inner side portion metal pin 4*a* which is paired with the above outer side portion metal pin 4*b* are connected to each other through one lower side portion wiring electrode pattern 4*d* formed on the lower surface of the insulation layer 2; the inner side portion metal pin 4*a* connected as discussed above is positioned on a predetermined side (counterclockwise direction in FIG. 1) of the inner side portion metal pin 4*a* paired as discussed above. With the above-discussed connection structure of the inner side portion and outer side portion metal pins 4*a* and 4*b*, and the upper side portion and lower side portion wiring electrode patterns 4*c* and 4*d*, the coil electrode 4 that is spirally wound around the ring-shaped magnetic body core 3 is formed. The upper side portion and lower side portion wiring electrode patterns 4*c* and 4*d* can be formed on the upper surface (or the lower surface) of the insulation layer by a printing technique that uses a conductive paste containing a metal such as Cu, Ag, or the like, for example.

The input metal pin 5*a* is connected to one end of the coil electrode 4, and the output metal pin 5*b* is connected to the other end of the coil electrode 4. To be specific, the upper and lower end surfaces of each of the input and output metal pins 5*a* and 5*b* are respectively exposed from the main surfaces of the insulation layer 2, and the upper end surface of the input metal pin 5*a* is connected to the upper side portion wiring electrode pattern 4*c* forming the one end of the coil electrode 4. The upper end surface of the output metal pin 5*b* is connected to the upper side portion wiring electrode pattern 4*c* forming the other end of the coil electrode 4. Then, the lower end surfaces of the input and output metal pins 5*a* and 5*b* respectively function as terminals for external connection. Note that the input and output metal pins 5*a* and 5*b* are, like the coil metal pins 4*a* and 4*b*, also formed with a metallic material, such as Cu, Au, Ag, Al, a Cu-based alloy, or the like, that is generally employed as a wiring electrode.

With both the input and output metal pins 5*a* and 5*b* formed to be larger in diameter than the coil metal pins 4*a* and 4*b*, the lower end surface of each of the input and output metal pins 5*a* and 5*b* is formed to be wider than a cross-section area (for example, the upper end surface) of each of the coil metal pins 4*a* and 4*b*. In other words, the coil component 1*a* is so constituted as to raise the mountability of the coil component 1*a* to the exterior and the connection strength thereof by enlarging the lower end surfaces of the input and output metal pins 5*a* and 5*b* which serve as connection surfaces with the exterior (cross-section areas: input and output metal pins 5*a*, 5*b*>coil metal pins 4*a*, 4*b*).

In the case where the diameter of a metal pin is small, a metal pin made of a Cu—Ni alloy which has an advantage in strength is used in some case in consideration of the strength. However, the Cn—Ni alloy has a problem that its resistance value becomes high in comparison with pure Cu. In the case where the input and output metal pins 5*a* and 5*b* are formed to be larger in diameter than the coil metal pins 4*a* and 4*b*, the strength thereof is raised, which makes it possible to use pure Cu for the input and output metal pins 5*a* and 5*b*.

It is preferable that a gap between at least one of the input and output metal pins 5*a*, 5*b* and the adjacent coil metal pins 4*a*, 4*b* be wider than a gap between the mutually adjacent coil metal pins 4*a* and 4*b* (in other words, a gap between the inner side portion metal pins 4*a*, and a gap between the outer side portion metal pins 4*b*). With this, even in the case where the input and output metal pins 5*a* and 5*b* are formed to be larger in diameter so that the connection surfaces with the exterior (exposed surfaces from the insulation layer) become larger, a risk that the input and output metal pins 5*a*, 5*b* and the adjacent coil metal pins 4*a*, 4*b* are short-circuited due to solder or the like can be reduced.

As such, according to the above-described embodiment, the coil electrode 4 includes the plurality of coil metal pins 4*a* and 4*b* that are arranged around the magnetic body core 3 in a state of being provided upright in the thickness direction of the insulation layer 2. In the case of the metal pin, in comparison with a via conductor formed by filling a conductive paste into a through-hole passing through in the thickness direction of the insulation layer, a through-hole conductor formed by plating a wall surface of a through-hole, or the like, the characteristics of the coil component 1*a* can be improved because the resistance of the metal pin can be lowered even if the conductor size is the same as the via conductor, the through-hole conductor, or the like.

In the case of the via conductor, the through-hole conductor, or the like that needs the formation of a through-hole, it is necessary to set a predetermined interval between mutually adjacent conductors in order to form independent through-holes. This limits the increasing of the number of turns of the coil by shortening a gap between the mutually adjacent conductors. Meanwhile, in the case of the coil metal pins 4*a* and 4*b* in which a through-hole is not formed, because a gap between the mutually adjacent metal pins 4*a* and 4*b* can be shortened with ease, it is possible to increase the number of turns of the coil electrode 4 and improve the coil characteristics (realization of a higher inductance).

The lower end surfaces of the input metal pin 5*a* and the output metal pin 5*b* that are exposed from the insulation layer respectively function as connection surfaces with the exterior. For example, in the case where the input metal pin 5*a* and the output metal pin 5*b* are formed to have the same diameter size as the coil metal pins 4*a* and 4*b*, when the coil metal pins 4*a* and 4*b* are made smaller in diameter in order to increase the number of turns of the coil electrode 4, the input and output metal pins 5*a* and 5*b* also become smaller in diameter causing the reduction in the connection surface with the exterior, thereby degrading the mountability of the coil component 1*a* to the exterior. On the other hand, in the case where both the input and output metal pins 5*a* and 5*b* are formed to be larger in diameter than the coil metal pins 4*a* and 4*b*, the connection surface with exterior can be easily enlarged, whereby the mountability of the coil component 1*a* can be raised while improving the coil characteristics by increasing the number of turns of the coil electrode 4, or the like. In addition, because an area of the lower edge surface of each of the input and output metal pins 5*a* and 5*b* becomes wider, the connection area with the exterior becomes wider, thereby making it possible to enhance the connection strength with the exterior.

Second Embodiment

Figure 2:
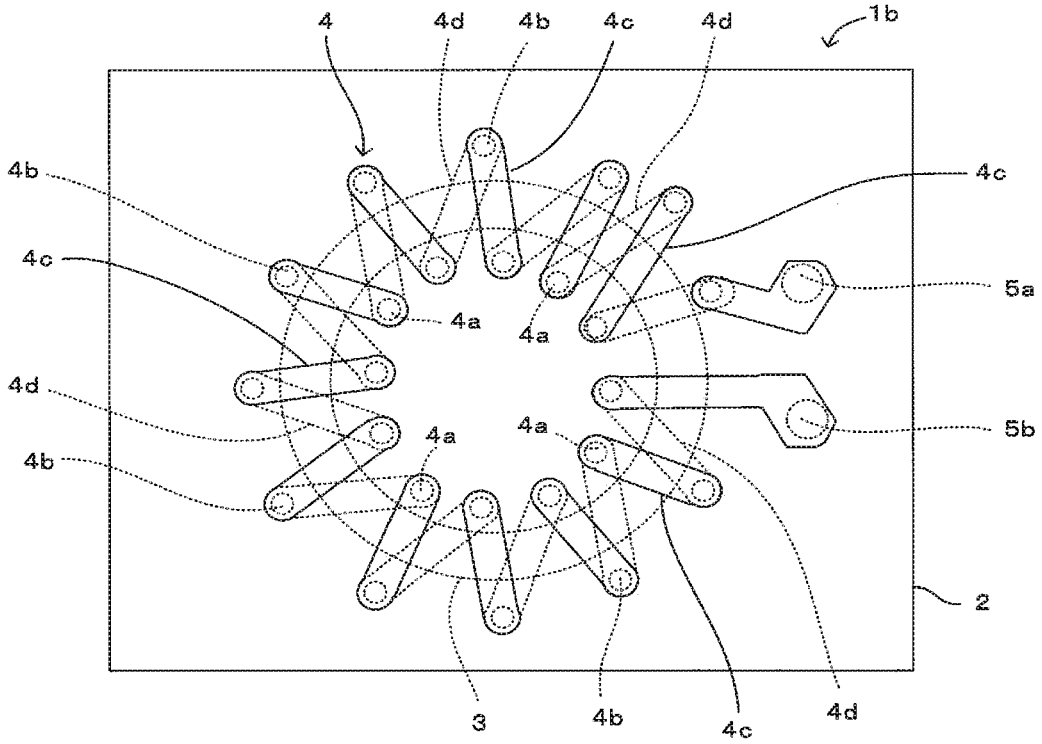
FIG. 2 is a plan view of a coil component according to a second embodiment of the present disclosure.

A coil component 1*b* according to a second embodiment of the present disclosure will be described with reference to FIG. 2. FIG. 2 is a plan view of the coil component 1*b*.

The coil component 1*b* according to the present embodiment differs from the coil component 1*a* of the first embodiment having been described with reference to FIG. 1 in a point that, as shown in FIG. 2, the input and output metal pins 5*a* and 5*b* are arranged in the positions further distanced from the magnetic body core 3 than the positions of the coil metal pins 4*a* and 4*b*. Because other constituent elements are the same as those of the first embodiment, the same reference signs are assigned thereto and description thereof will be omitted.

In this case, the input and output metal pins 5*a* and 5*b* are arranged in an outer side portion relative to the outer side portion metal pins 4*b* that are aligned along the outer circumference surface of the magnetic body core 3. With this, the input and output metal pins 5*a*, 5*b* can be prevented from making contact with the coil metal pins 4*a*, 4*b* because the input and output metal pins 5*a*, 5*b* can be distanced from the coil electrode 4. Further, it is easy to increase the number of turns of the coil by increasing the number of the coil metal pins 4*a*, 4*b* to the extent given by the input and output metal pins 5*a*, 5*b* being not arranged around the magnetic body core 3. Note that it is not necessary for both of the input and output metal pins 5*a* and 5*b* to be further distanced from the magnetic body core 3 than the coil metal pins 4*a* and 4*b*; any one of them, that is, the input metal pin 5*a*, for example, may be arranged in a position further distanced from the magnetic core 3 than the positions of the coil metal pins 4*a* and 4*b*.

Third Embodiment

Figure 3:
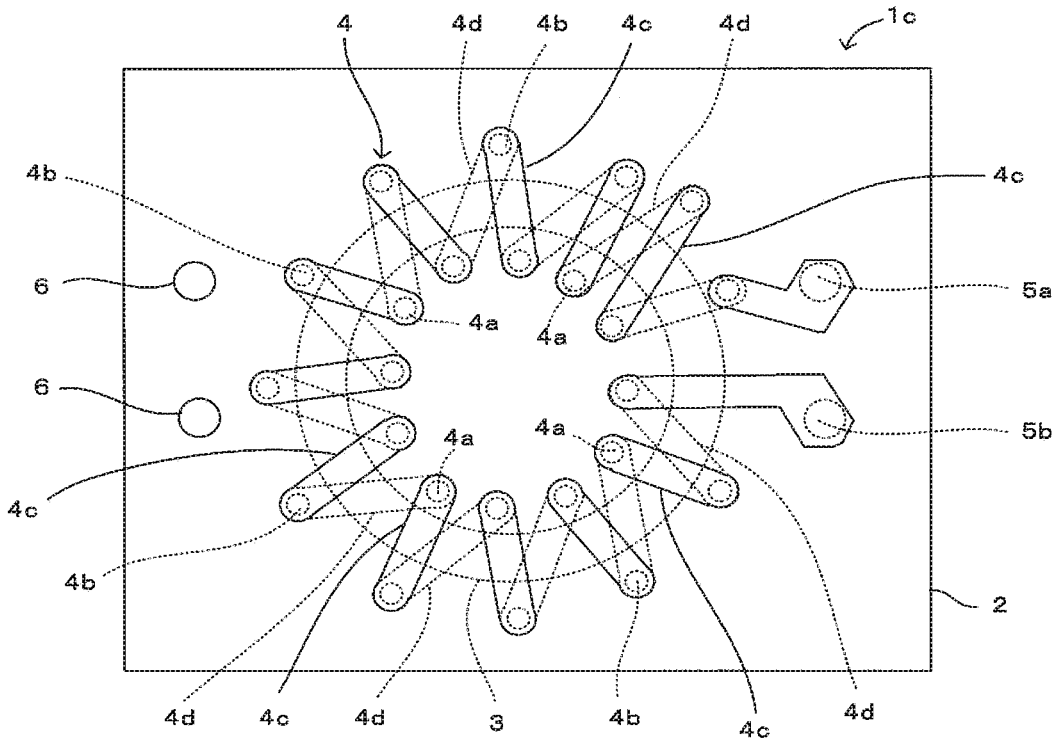
FIG. 3 is a plan view of a coil component according to a third embodiment of the present disclosure.

A coil component 1*c* according to a third embodiment of the present disclosure will be described with reference to FIG. 3. FIG. 3 is a plan view of the coil component 1*c*.

The coil component 1*c* of the present embodiment differs from the coil component 1*b* of the second embodiment having been described with reference to FIG. 2 in a point that, as shown in FIG. 3, a dummy metal pin 6 for external connection, which is not electrically connected to the coil electrode 4, is further provided. Because other constituent elements are the same as those of the coil component 1*b* of the second embodiment, the same reference signs are assigned thereto and description thereof will be omitted.

In this case, two dummy metal pins 6 are provided upright in the thickness direction of the insulation layer 2 in a state in which upper and lower end surfaces thereof are exposed from the main surfaces of the insulation layer 2, and the lower end surface is used as a connection surface with the exterior. The dummy metal pins 6 are both arranged in respective point-symmetric positions in plan view relative to the input and output metal pins 5*a* and 5*b* (the center of the insulation layer 2 is the center of the symmetry) and are formed to be larger in diameter than the coil metal pins 4*a* and 4*b*. In the present embodiment, the diameter size of the dummy metal pins 6 is equal to that of the input and output metal pins 5*a* and 5*b*. The dummy metal pins 6 can be formed with the same material as that of the input and output metal pins 5*a* and 5*b*.

When the magnetic body core 3 is a ring-shaped toroidal core, there are many cases where the input metal pin 5*a* and the output metal pin 5*b* are arranged close to each other with the increased number of turns of the coil. In such a case, if only the input and output metal pins 5*a* and 5*b* are the terminals for external connection in the coil component 1*c*, connection portions with the exterior are arranged in a localized manner. In this case, mounting failure is likely to occur because the coil component 1*c* may be slanted, shifted in position, and so on at the time of mounting the coil component 1*c* on a motherboard using solder or the like. In light of the above issue, by additionally providing the dummy metal pins 6 for external connection and increasing the number of connection portions with the exterior, the above-mentioned mounting failure can be reduced. Further, in the case where the dummy metal pins 6 are arranged to be point-symmetric in plan view relative to the input and output metal pins 5*a* and 5*b*, the connection portions with the exterior are positionally well-balanced, whereby mounting failure can be further reduced.

Moreover, because the connection area with the exterior is enlarged to the extent given by the dummy metal pins 6 being provided, the connection strength with the exterior can be enhanced.

It is not absolutely necessary for the dummy metal pins 6 to be larger in diameter than the coil metal pins 4*a* and 4*b*, and the dummy metal pins 6 may be substantially as large in diameter as the coil metal pins 4*a* and 4*b*. It is sufficient if the arrangement relationship between the dummy metal pins 6 and the input and output metal pins 5*a*, 5*b* is as follows: that is, as shown in FIG. 3, in the case where the input and output metal pins 5*a* and 5*b* are collected on the right side in plan view, for example, the dummy metal pins 6 are arranged in well-balanced positions to some degree, such as being arranged on the left side.

Fourth Embodiment

Figure 4:
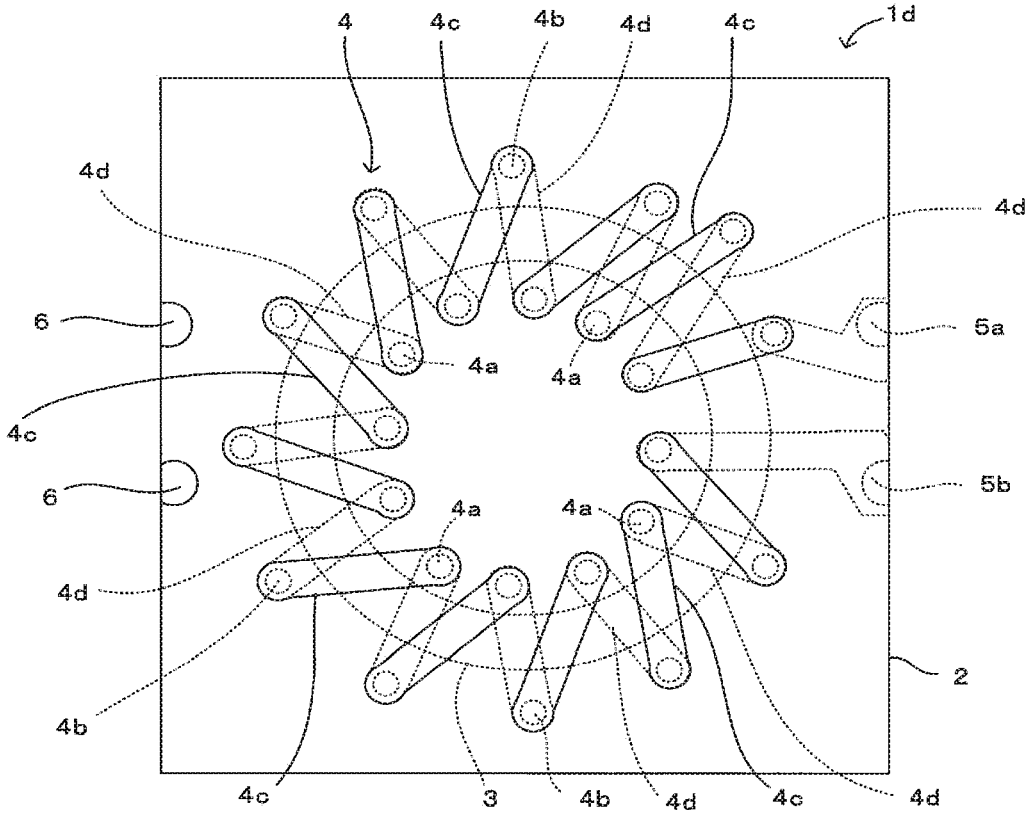
FIG. 4 is a plan view of a coil component according to a fourth embodiment of the present disclosure.

A coil component 1*d* according to a fourth embodiment of the present disclosure will be described with reference to FIGS. 4 and 5. FIG. 4 is a plan view of the coil component 1*d*, and FIG. 5 is a cross-sectional view of the coil component 1*d*.

Figure 5:
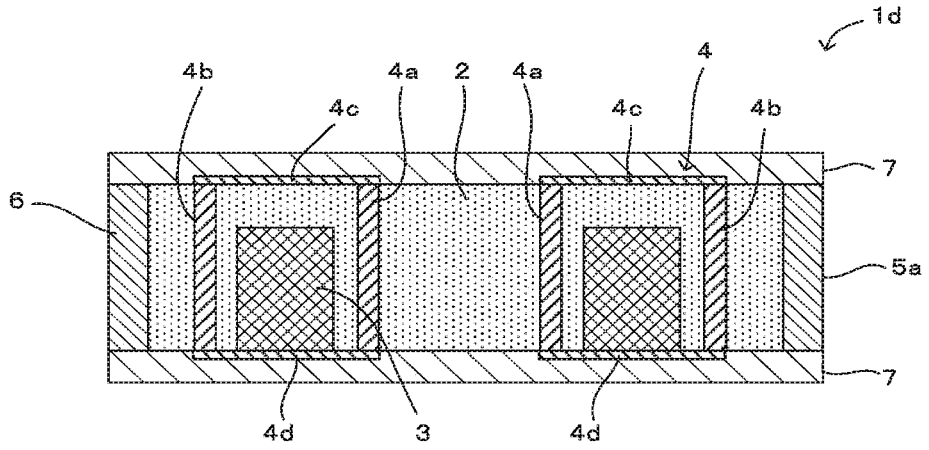
FIG. 5 is a cross-sectional view of the coil component in FIG. 4.

The coil component 1*d* of the present embodiment differs from the coil component 1*c* of the third embodiment having been described with reference to FIG. 3 in a point that, as shown in FIGS. 4 and 5, the input and output metal pins 5*a*, 5*b*, and the dummy metal pins 6 are arranged in a circumference edge portion of the insulation layer 2 in plan view, and part of the circumference side surface of each of the stated metal pins is provided being exposed from the insulation layer 2. Because other constituent elements are the same as those of the coil component 1*c* of the third embodiment, the same reference signs are assigned thereto and description thereof will be omitted.

In this case, covering insulation films 7 for covering the upper side portion and lower side portion wiring patterns 4*c* and 4*d* of the coil electrode 4 are respectively provided on both the main surfaces of the insulation layer 2. Part of the circumference side surface of each of the input and output metal pins 5*a*, 5*b* and the dummy metal pins 6 that is exposed from the insulation layer 2 functions as an connection surface with the exterior. Further, the part of the circumference side surface of each of the input and output metal pins 5*a*, 5*b* and the dummy metal pins 6 is so configured as to form the same plane surface along with a predetermined side surface of the insulation layer 2. The lower end surfaces of the input and output metal pins 5*a*, 5*b* and the dummy metal pins 6 may also be used as respective connection surfaces with the exterior without forming the covering insulation film 7 on the lower surface side of the insulation layer 2.

(Manufacturing Method for Coil Component 1*d*)

Next, an example of a manufacturing method for the coil component 1*d* will be described with reference to FIGS. 6A through 6F. FIGS. 6A through 6F include diagrams for explaining the manufacturing method for the coil component 1*d*, and FIGS. 6A through 6F represent respective processes thereof.

As an example of the manufacturing method for the coil component 1*d*, a case in which, after the formation of assemblage of a plurality of coil components 1*d*, singulation is performed by cutting the assemblage with a dicing machine to manufacture individual coil components 1*d* will be hereinafter described.

Figure 6A:
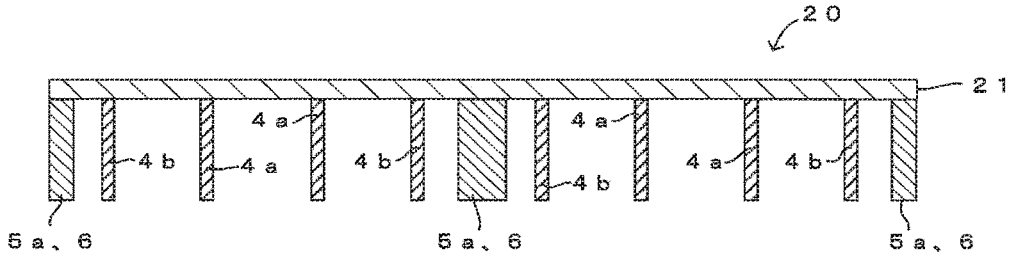
FIGS. 6A through 6F include diagrams for explaining a manufacturing method for a coil component.

First, as shown in FIG. 6A, assemblage 20 of the metal pins 4*a*, 4*b*, 5*a*, 5*b*, and 6 is prepared. Specifically, one end of each of the metal pins 4*a*, 4*b*, 5*a*, 5*b*, and 6 is supported by or mounted on a plate-like transfer body 21. The transfer body 21 is a member in which a holding layer formed of an adhesive layer or a sticking layer is provided on one surface of a plate member formed with a resin material such as glass epoxy resin or the like. Then, by pushing the transfer body 21 from above in the vertical direction toward the one end of each of the metal pins 4*a*, 4*b*, 5*a*, 5*b*, and 6, the one end of the metal pins 4*a*, 4*b*, 5*a*, 5*b*, and 6 are made to adhere or stick to the holding layer, thereby being supported by the transfer body 21.

The holding layer of the transfer body 21 may be formed by applying a liquid adhesive, a liquid sticking agent, or the like on the one surface of the plate member, or formed by pasting an adhesive sheet, a sticking sheet, or the like on the one surface of the plate member.

As discussed above, the assemblage 20 of the metal pins 4*a*, 4*b*, 5*a*, 5*b*, and 6 is completed. In this manufacturing method, the mutually adjacent input and output metal pins 5*a*, 5*b* and the dummy metal pin 6 are integrally formed, and are so constituted as to be divided into individual metal pins 5*a*, 5*b*, and 6 by being cut with a dicing machine at a time of singulation of the coil 1*d*, which will be explained later. In addition, such a setting is made in the above constitution that the diameter size of the metal pins 5*a*, 5*b*, and 6 after being divided is larger than the diameter size of the coil metal pins 4*a* and 4*b*.

Figure 6B:
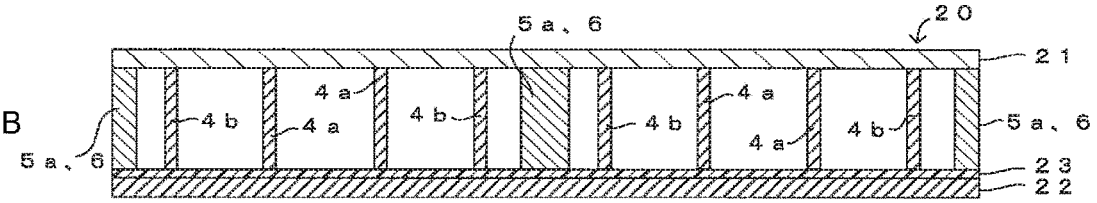

Next, as shown in FIG. 6B, a pin fixing resin layer 23 is formed on a resin sheet with a release layer 22, and the assemblage 20 of the metal pins 4*a*, 4*b*, 5*a*, 5*b*, and 6 is mounted on the resin sheet with a release layer 22 so that the other end of each of the metal pins 4*a*, 4*b*, 5*a*, 5*b*, and 6 makes contact with the pin fixing resin layer 23. At this time, the pin fixing resin layer 23 is formed in a half-cured state, and a resin of the pin fixing resin layer 23 is completely cured after the assemblage 20 being mounted so that the metal pins 4*a*, 4*b*, 5*a*, 5*b*, and 6 are fixed on the resin sheet with a release layer 22.

Figure 6C:
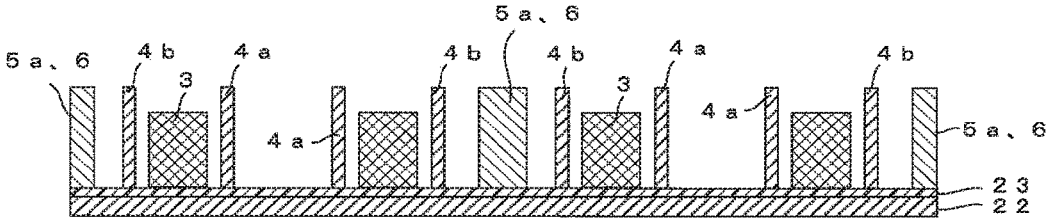
Figure 6D:
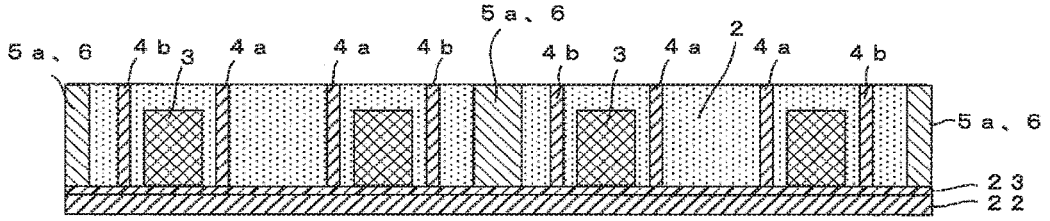

Next, as shown in FIG. 6C, after the transfer body 21 being separated, the magnetic body cores 3 are each arranged in a predetermined position. Subsequently, the insulation layer 2 for sealing the metal pins 4*a*, 4*b*, 5*a*, 5*b*, and 6 as well as the magnetic body cores 3 is formed on the upper surface of the pin fixing resin layer 23 (see FIG. 6D). In this case, the insulation layer 2 can be formed, using a sealing resin such as epoxy resin or the like, by an application method, a printing method, a compression mold method, a transfer mold method, or the like.

Figure 6E:
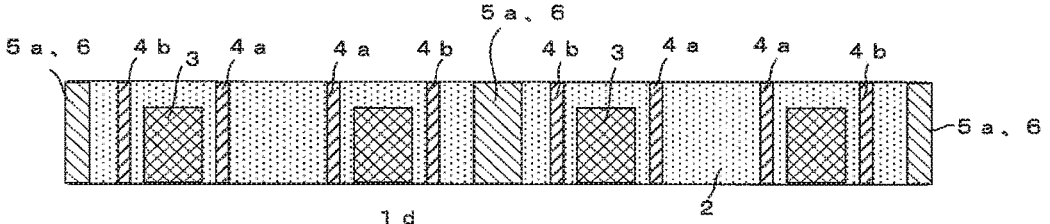
Figure 6F:
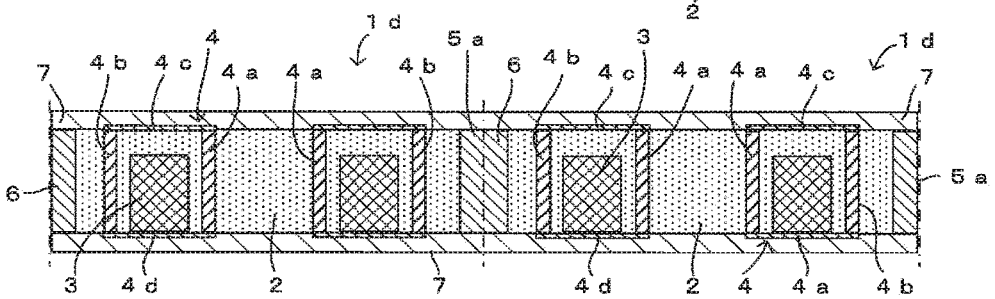

Next, after the resin sheet with a release layer 22 being separated, the upper and lower surfaces of the insulation layer 2 are polished or ground (see FIG. 6E). At this time, the upper and lower end surfaces of each of the metal pins 4*a*, 4*b*, 5*a*, 5*b*, and 6 are exposed from the insulation layer 2.

Next, the upper side portion and lower side portion wiring electrode patterns 4*c* and 4*d* are formed on the main surfaces of the insulation layer 2. At this time, the wiring electrode patterns 4*c* and 4*d* can be formed by, for example, screen printing in which a conductive paste containing a metal such as Cu, Ag, or the like is used. Further, the wiring electrode patterns 4*c* and 4*d* having been formed with the above-mentioned conductive paste may be taken as foundation electrodes, and Cu plating or the like may be performed on the surfaces of the stated foundation electrodes. With this, because resistivity of the wiring electrode patterns 4*c* and 4*d* can be lowered in comparison with a case in which the wiring electrode patterns are formed with only the conductive paste, coil characteristics can be improved.

Next, the covering insulation films 7 are formed on both the main surfaces of the insulation layer 2 on which the wiring electrode patterns 4*c* and 4*d* have been formed. The covering insulation film 7 can be formed with an epoxy resin, a resist resin, or the like. Finally, singulation is performed on the assemblage of the coil components 1*d* by cutting the assemblage with a dicing machine or the like, thereby obtaining each individual coil component 1*d* (see FIG. 6F). At this time, the assemblage of the coil components 1*d* is cut along a dicing line indicated by a dot-dash line in FIG. 6F. With this, part of the circumference side surface of each of the input and output metal pins 5*a*, 5*b* and the dummy metal pins 6 is exposed from the insulation layer 2, and each exposed surface functions as a connection surface with the exterior in the coil component 1*d*.

As such, according to the present embodiment, the input and output metal pins 5*a*, 5*b* and the dummy metal pins 6 are formed to be larger in diameter than the coil metal pins 4*a* and 4*b*, and part of the circumference surfaces thereof are exposed from the insulation layer 2 and are configured so as to function as connection surfaces with the exterior. With this, in comparison with a case in which only the end surfaces are configured to function as connection surfaces with the exterior, connection surface areas can be enlarged with ease and the mountability of the coil component 1*d* is improved. In addition, because visibility of the connection portions with the exterior is improved, visual inspection can be easily performed on the connection portions after the coil component 1*d* being mounted on an external motherboard or the like.

(Variation on Coil Component 1*d*)

Figure 7:
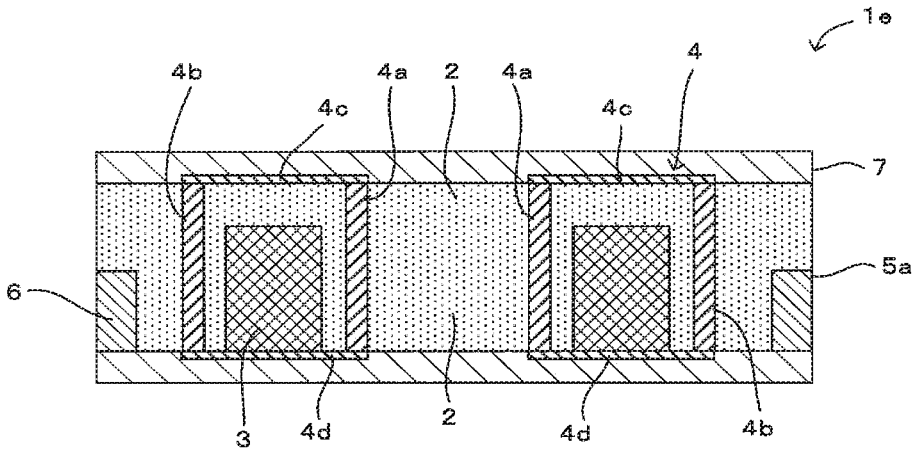
FIG. 7 is a diagram illustrating a variation on the coil component in FIG. 4.

Next, a variation on the coil component 1*d* will be described with reference to FIG. 7. FIG. 7 is a cross-sectional view of a coil component 1*e* according to the present variation.

In the coil component 1*d* according to the fourth embodiment discussed before, the length of each of the input and output metal pins 5*a*, 5*b* and the dummy metal pins 6 is formed to be approximately equal to the length of each of the coil metal pins 4*a* and 4*b*; however, in this variation, the length of the input and output metal pins 5*a*, 5*b* and the dummy metal pins 6 (length in the thickness direction of the insulation layer 2) may be formed to be shorter than that of the coil metal pins 4*a* and 4*b*.

The length of the coil metal pins 4*a* and 4*b* constituting part of the coil electrode 4 is, in general, approximately equal to the thickness of the magnetic body core 3. Because of this, in the case where part of the circumference side surfaces of the input and output metal pins 5*a*, 5*b* and the dummy metal pins 6 are exposed from the insulation layer 2 so as to serve as side surface electrodes, there is a case in which the size of the exposed surfaces in the thickness direction of the insulation layer 2 becomes excessively large. In such a case, because the amount of solder used for connection with the exterior is large, there is a risk that a short circuit is caused by the solder between the mutually adjacent input and output metal pins 5*a*, 5*b* and between the dummy metal pins 6. Then, the length of the input and output metal pins 5*a*, 5*b* and the length of the dummy metal pins 6 are formed to be shorter than the length of the coil metal pins 4*a* and 4*b* so as to optimize the size of the exposed surfaces in the thickness direction of the insulation layer 2. With this, because the amount of solder needed for the mounting can be reduced, even in the case where a pitch between the input and output metal pins 5*a*, 5*b* and a pitch between the dummy metal pins 6 become smaller, the occurrence of a short circuit caused by the solder among the mutually adjacent metal pins 5*a*, 5*b*, and 6 can be reduced.

Fifth Embodiment

Figure 8:
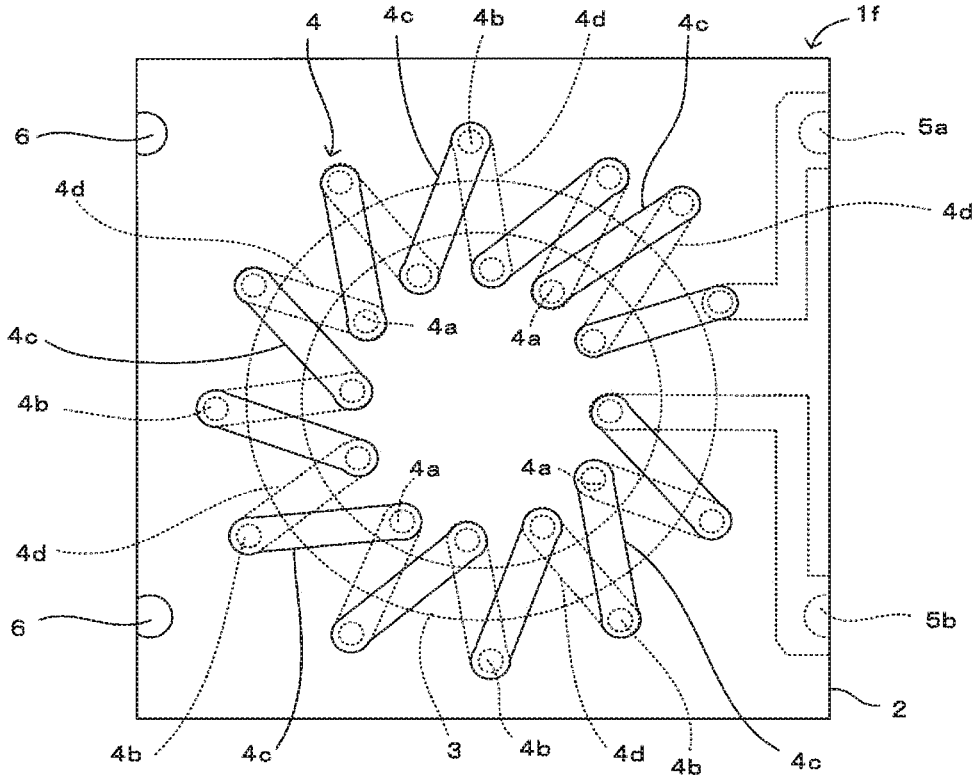
FIG. 8 is a plan view of a coil component according to a fifth embodiment of the present disclosure.

A coil component if according to a fifth embodiment of the present disclosure will be described with reference to FIG. 8. FIG. 8 is a plan view of the coil component 1*f*.

The coil component if according to the present embodiment differs from the coil component 1*d* of the fourth embodiment having been described with reference to FIG. 4 in a point that one of the input and output metal pins 5*a*, 5*b* and the dummy metal pins 6 is arranged in each of four corners of the insulation layers 2 formed in a rectangular shape in plan view. Because other constituent elements are the same as those of the coil component 1*d* of the fourth embodiment, the same reference signs are assigned thereto and description thereof will be omitted.

In the case where the connection portions with the exterior are constituted in the four portions as described above, because the arrangement balance of the connection portions is further improved when the metal pins 5*a*, 5*b*, and 6 are arranged one by one in the four corners of the insulation layer 2 formed in a rectangular shape in plan view, the mountability the coil component if to the exterior is improved in comparison with the coil component 1*d* of the fourth embodiment.

Sixth Embodiment

Figure 9:
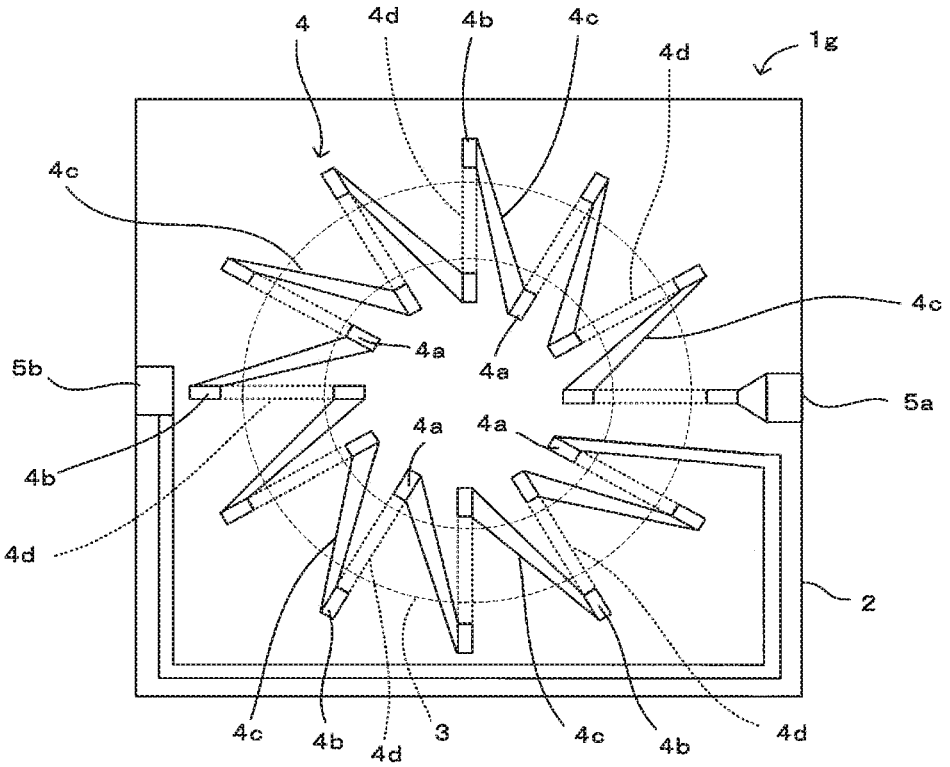
FIG. 9 is a plan view of a coil component according to a sixth embodiment of the present disclosure.

A coil component 1*g* according to a sixth embodiment of the present disclosure will be described with reference to FIGS. 9 and 10. FIG. 9 is a plan view of the coil component 1*g*, and FIG. 10 is a cross-sectional view of the coil component 1*g*.

Figure 10:
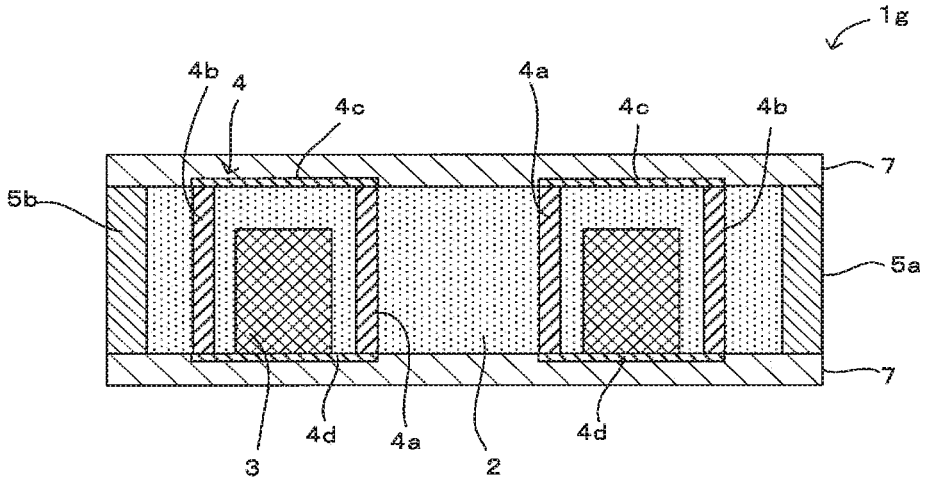
FIG. 10 is a cross-sectional view of the coil component in FIG. 9.

The coil component 1*g* according to the present embodiment differs from the coil component 1*a* of the first embodiment having been described with reference to FIG. 1 in a point that, as shown in FIGS. 9 and 10, the shape of a cross-section of each of the metal pins 4*a*, 4*b*, 5*a*, and 5*b* is rectangular, part of the circumference side surface of each of the input and output metal pins 5*a*, 5*b* is exposed from the insulation layer 2 so as to form a connection surface with the exterior, and the covering insulation films 7 are provided on both the main surfaces of the insulation layer 2. Because other constituent elements are the same as those of the coil component 1*a* of the first embodiment, the same reference signs are assigned thereto and description thereof will be omitted.

In this case, the input and output metal pins 5*a* and 5*b* are formed to be larger in diameter than the coil metal pins 4*a* and 4*b*, and one side surface of each of the input and output metal pins 5*a* and 5*b* is arranged in the circumference edge portion of the insulation layer 2 in plan view so as to be exposed from the side surface of the insulation layer 2. At this time, the exposed side surface of each of the input and output metal pins 5*a* and 5*b* is so configured as to form the same plane surface along with the side surface of the insulation layer 2. The coil component 1*g* as discussed above can be formed, for example, in the same manner as the coil component 1*d* according to the fourth embodiment having been described with reference to FIGS. 6A through 6F. That is, a dicing blade is made to penetrate the input and output metal pins 5*a* and 5*b*, which are provided upright and covered with the insulation layer 2, in the thickness direction of the insulation layer 2, and cut both the metal pins 5*a* and 5*b* in the lengthwise direction along with the insulation layer 2, whereby one side surface of each of the metal pins 5*a* and 5*b* is exposed from the side surface of the insulation layer 2.

Here, if the shape of the cross-section of each of the metal pins 5*a* and 5*b* is circular like in the coil component 1*a* of the first embodiment, for example, an area of the side surface of each of the metal pins 5*a* and 5*b* exposed from the insulation layer 2 varies due to a shift in position of the dicing blade. Then, by making the shape of the cross-section of each of the metal pins 5*a* and 5*b* be rectangular, even if the position of the dicing blade is shifted (for example, shifted in the right-left direction in FIG. 9), the amount of variation in the area of the exposed surface can be suppressed, whereby a variation in the area of one side surface of each of the metal pins 5*a* and 5*b* exposed from the insulation layer 2 can be reduced.

In the present embodiment, the shape of the cross-section of each of the coil metal pins 4*a* and 4*b* may be circular. Moreover, in order to further improve the mountability of the coil component 1*g*, dummy metal pins having the same structure as the input and output metal pins 5*a* and 5*b* may be additionally provided. Further, the structure may be such that the covering insulation films 7 are not provided on both the main surfaces of the insulation layer 2.

(Variation on Coil Component 1g)

Figure 11:
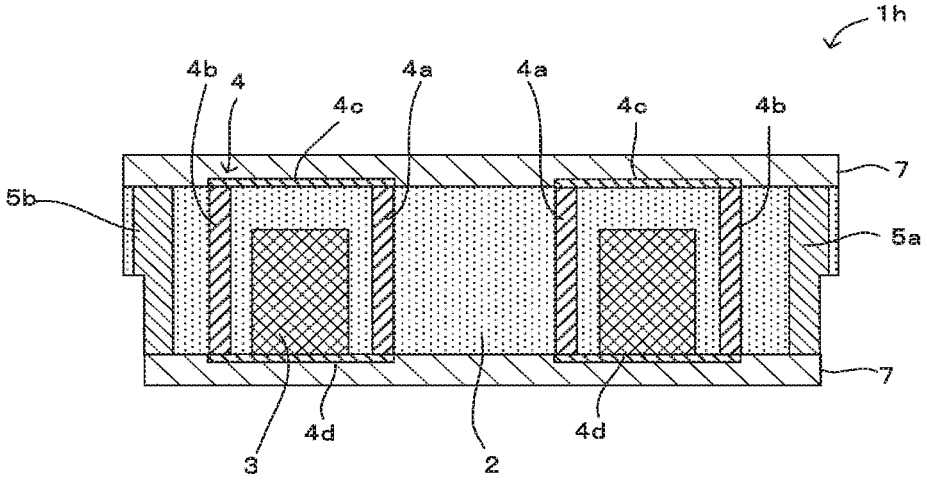
FIG. 11 is a diagram illustrating a variation on the coil component in FIG. 9.

Next, a variation on the coil component 1g will be described with reference to FIG. 11. FIG. 11 is a cross-sectional view of a coil component 1h according to the present variation.

The coil component 1g according to the sixth embodiment discussed above is configured such that the whole one side surface of each of the input and output metal pins 5a and 5b is exposed. However, part of the one side surface of each of the input and output metal pins 5a and 5b in the lengthwise direction (thickness direction of the insulation layer 2) may be covered with the insulation layer 2. With this, the insulation layer 2 can protect the connection portions between the input and output metal pins 5a, 5b and the upper side portion wiring electrode patterns 4c. In addition, in order to optimize the amount of solder used for connection with the exterior (adjustment of solder fillet extension), an area of the connection surface with the exterior can be adjusted as well.

The coil component 1h according to the present variation can be constituted by substantially the same method as the manufacturing method for the coil component 1d of the fourth embodiment having been described with reference to FIGS. 6A through 6F. Note that, however, the coil component 1h can also be manufactured in the following manner: the mutually adjacent input and output metal pins 5a and 5b are individually formed in advance in a state of the assemblage of the metal pins 4a, 4b, 5a, and 5b; and in a process of cutting with a dicing machine (see FIG. 6F), halfway-cutting is carried out with a wide-width dicing blade from the lower side portion, and the upper side portion is cut with a dicing blade whose width is smaller than the above blade, thereby performing singulation.

Seventh Embodiment

Figure 12:
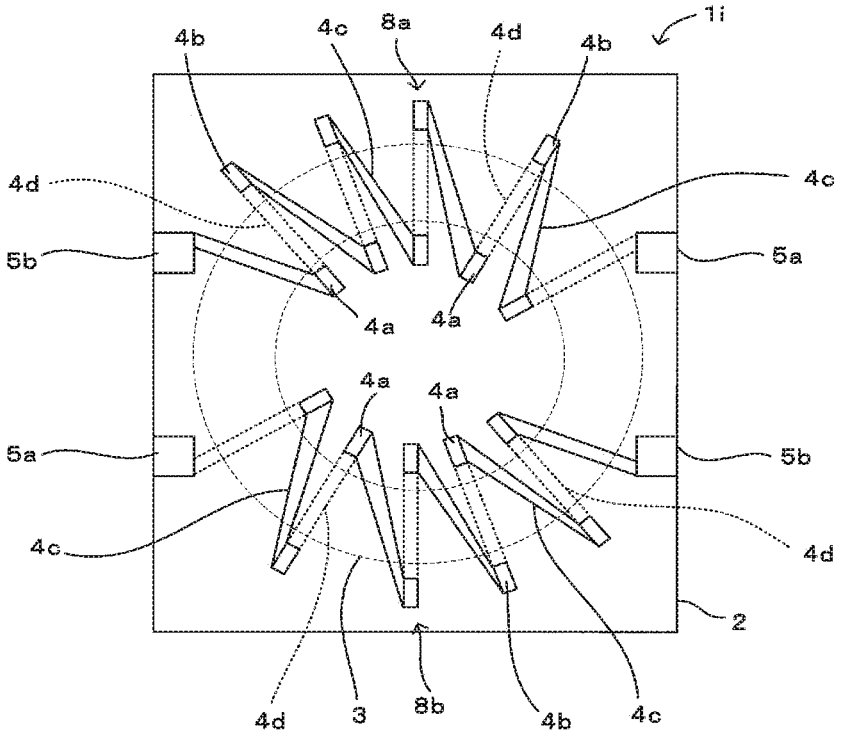
FIG. 12 is a plan view of a coil component according to a seventh embodiment of the present disclosure.

A coil component 1i according to a seventh embodiment of the present disclosure will be described with reference to FIG. 12. FIG. 12 is a plan view of the coil component 1i.

The coil component 1i according to the present embodiment differs from the coil component 1g of the sixth embodiment having been described with reference to FIG. 9 in a point that, as shown in FIG. 12, a choke coil is constituted by including two coil electrodes, that is, coil electrodes 8a and 8b, and the input and output metal pins 5a and 5b of each of the coil electrodes 8a and 8b function as one outer side portion metal pin 4b. Because other constituent elements are the same as those of the coil component 1g of the sixth embodiment, the same reference signs are assigned thereto and description thereof will be omitted.

With this, the coil component 1i including a choke coil of high mountability and excellent coil characteristics can be provided. Further, because the input and output metal pins 5a and 5b function as the outer side portion metal pins 4b, a total length of each of the coil electrodes 8a and 8b can be shortened, which makes it possible to improve the coil characteristics.

Eighth Embodiment

Figure 13:
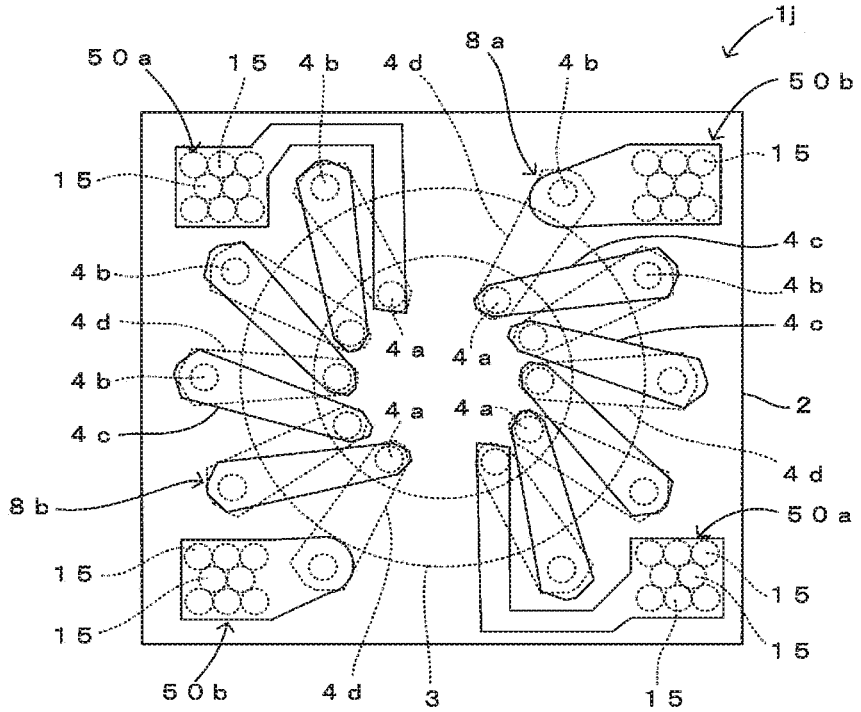
FIG. 13 is a plan view of a coil component according to an eighth embodiment of the present disclosure.
Figure 14:
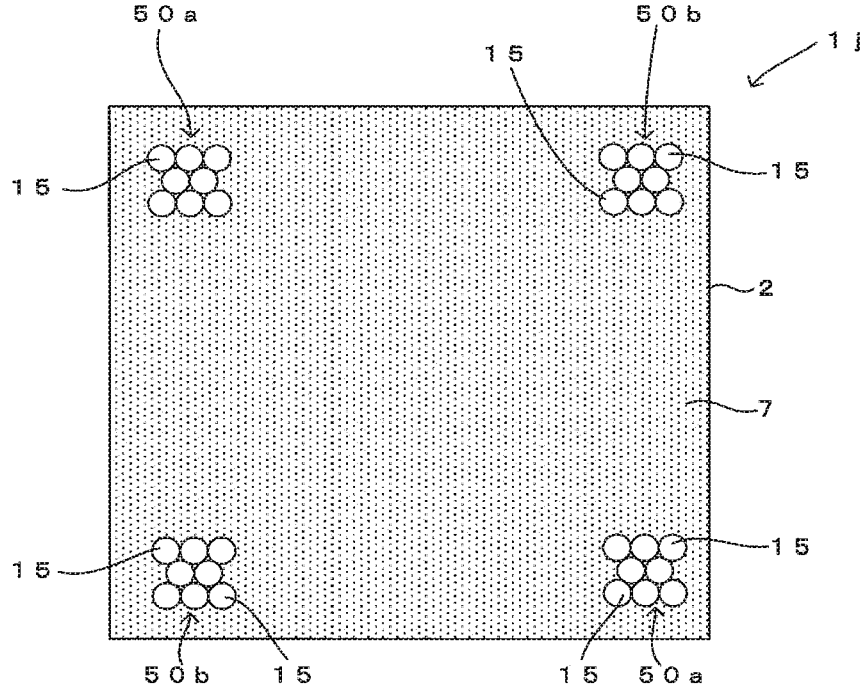
FIG. 14 is a bottom view of the coil component in FIG. 13.

A coil component 1j according to an eighth embodiment of the present disclosure will be described with reference to FIGS. 13 and 14. FIG. 13 is a plan view of the coil component 1j, and FIG. 14 is a bottom view of the coil component 1j.

The coil component 1j according to the present embodiment differs from the coil component 1b of the seventh embodiment having been described with reference to FIG. 12 in a point that, as shown in FIG. 13, the shape of a cross-section of each of the inner side portion and outer side portion metal pins 4a and 4b is circular, an input conductor of each of the two coil electrodes 8a and 8b is constituted of assemblage 50a of the plurality of input metal pins 5a, and an output conductor thereof is constituted of assemblage 50b of the plurality of output metal pins 5b. Because other constituent elements are the same as those of the coil component 1i of the seventh embodiment, the same reference signs are assigned thereto and description thereof will be omitted.

In this case, the input and output metal pins 5a and 5b are respectively provided upright in the thickness direction of the insulation layer 2. The assemblage 50a is formed of a bundle of the plurality of input metal pins 5a (eight in the present embodiment), and the assemblage 50b is formed of a bundle of the plurality of output metal pins 5b (eight in the present embodiment). At this time, the input and output metal pins 5a and 5b are respectively formed with the same material and with the same diameter size as those of the coil metal pins 4a and 4b. Further, as shown in FIG. 14, the lower surface of the insulation layer 2 is covered by the covering insulation film 7 with lower end surfaces of the assemblage 50a and assemblage 50b being exposed, and these lower end surfaces function as connection surfaces with the exterior. The covering insulation film 7 can be formed with, for example, a resist resin or the like.

In the case where, like in the coil component 1i of the seventh embodiment, the input and output conductors are respectively formed with a single input metal pin 5a and a single output metal pin 5b, it is necessary to prepare the metal pins 5a, 5b having a large diameter different from that of the coil metal pins 4a, 4b. In this case, when the metal pins 4a, 4b, 5a, and 5b are mounted on the transfer body 21 as shown in FIG. 6A, for example, it is necessary to carry out the mounting of the coil metal pins 4a and 4b separately from the mounting of the input and output metal pins 5a and 5b, which raises the manufacturing cost of the coil component 1i.

In contrast, with the constitution of the present embodiment, as the metal pins for forming the input and output metal pins 5a and 5b, the same metal pins as those for forming the coil metal pins 4a and 4b can be used, whereby the same effect can be obtained as in the coil component 1i of the seventh embodiment and further the manufacturing cost of the coil component 1j can be reduced.

Figure 15:
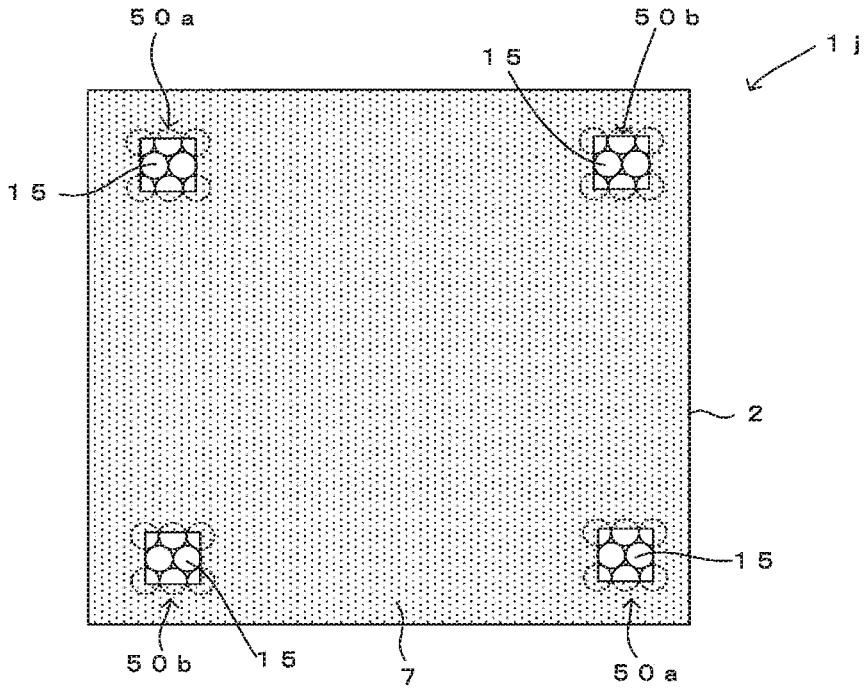
FIG. 15 is a diagram illustrating a variation on a covering insulation film in FIG. 14.

In the above embodiment, the covering insulation film 7 is configured to cover the lower surface of the insulation layer 2 with the whole lower end surface of each of the assemblage 50a and assemblage 50b being exposed. However, as shown in FIG. 15, the covering insulation film 7 may cover part of the lower end surface of each of the assemblage 50a and assemblage 50b. In this case, the covering insulation film 7 is formed by screen printing, for example; at the time of screen printing, in order to define exposure regions of the lower end surfaces of the assemblage 50a and assemblage 50b, openings each having a predetermined area are formed in the print mask. At this time, each opening area is formed to be smaller than the lower end surface of the assemblage 50a and assemblage 50b. With this, connection areas with the exterior can be adjusted in the assemblage 50a and assemblage 50b. Note that FIG. 15 is a diagram which illustrates a variation on the covering insulation film 7 in the coil component 1j and corresponds to FIG. 14.

Ninth Embodiment

Figure 16:
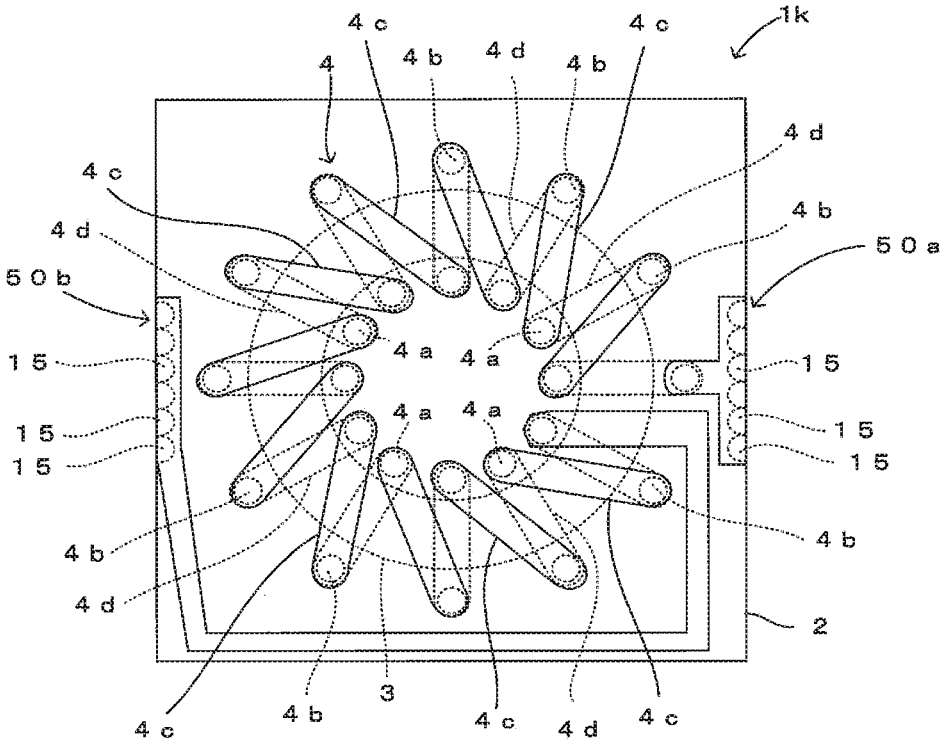
FIG. 16 is a plan view of a coil component according to a ninth embodiment of the present disclosure.
Figure 17:
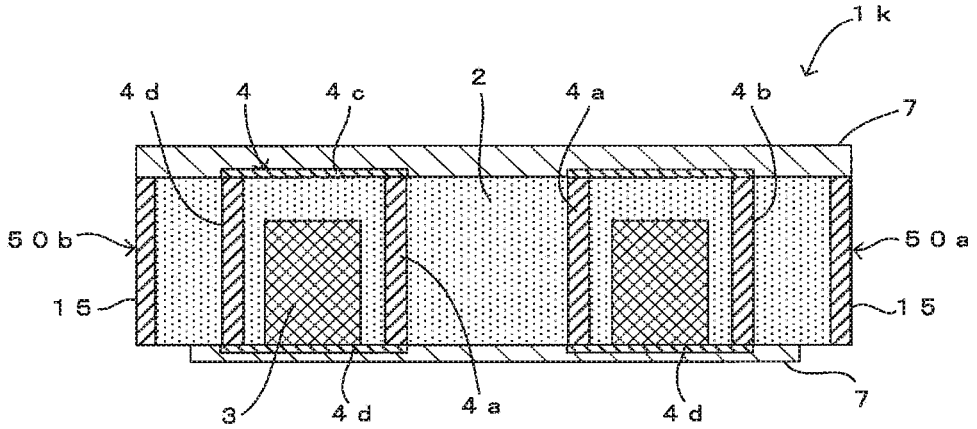
FIG. 17 is a cross-sectional view of the coil component in FIG. 16.

A coil component 1k according to a ninth embodiment of the present disclosure will be described with reference to FIGS. 16 and 17. FIG. 16 is a plan view of the coil component 1*k*, and FIG. 17 is a cross-sectional view of the coil component 1*k*.

The coil component 1*k* according to the present embodiment differs from the coil component 1*g* of the sixth embodiment having been described with reference to FIG. 9 in a point that, as shown in FIG. 16, the shape of a cross-section of each of the inner side portion and outer side portion metal pins 4*a* and 4*b* is circular, and input and output conductors (the input metal pin 5*a* and output metal pin 5*b*) of the coil electrode 4 are respectively constituted of the assemblage 50*a* and assemblage 50*b*, each of which is formed of the plurality of input metal pins 5*a* or output metal pins 5*b*. Because other constituent elements are the same as those of the sixth embodiment, the same reference signs are assigned thereto and description thereof will be omitted.

In this case, the assemblage 50*a*, which is the input conductor, is constituted such that the plurality of input metal pins 5*a* (six in this embodiment) provided upright in the thickness direction of the insulation layer 2 are aligned along a predetermined side of the insulation layer 2 formed in a rectangle shape in plan view. Further, the assemblage 50*b*, which is the output conductor, is constituted such that the plurality of output metal pins 5*b* (six in this embodiment) provided upright in the thickness direction of the insulation layer 2 are aligned along a side opposing the above-mentioned predetermined side. Here, the output metal pins 5*a* and 5*b* are formed to have the same diameter size as the coil metal pins 4*a* and 4*b*.

Part of the circumference side surface of each of the assemblage 50*a* and assemblage 50*b* is exposed from the side surface of the insulation layer 2. To rephrase, part of the circumference side surface of each of the input and output metal pins 5*a* and 5*b* is exposed from the side surface of the insulation layer 2 in each of the assemblage 50*a* and assemblage 50*b*. At this time, the assemblage 50*a* and assemblage 50*b* are formed so that the part of the circumference side surface thereof exposed from the side surface of the insulation layer 2 and the side surface of the insulation layer 2 form the same plane surface. Further, as shown in FIG. 17, the covering insulation film 7 for covering the lower surface of the insulation layer 2 is so formed as to expose the lower end surfaces of the assemblage 50*a* and assemblage 50*b*. Then, the part of the circumference side surface exposed from the insulation layer 2 and the lower end surface of the assemblage 50*a* and assemblage 50*b* are used as connection surfaces with the exterior.

For example, in the case where the cross-section shape of the metal pins as the input and output conductors is circular, when the cross-section areas thereof are enlarged to widen the connection areas with the exterior, an occupation region by those metal pins increases. In this case, because a free space inside the insulation layer 2 is particularly decreased, the degree of freedom in design of wiring electrodes (for example, the coil electrode 4) or the like is lowered. Meanwhile, in the constitution of the present embodiment, the input or output metal pins 5*a* or 5*b* are aligned along predetermined sides of the insulation layer 2, thereby making it possible to widen the connection surfaces with the exterior in the assemblage 50*a* and assemblage 50*b* and ensure a design space for wiring electrodes or the like in an inner side portion region of the insulation layer 2.

In addition, as the metal pins for forming the input and output metal pins 5*a* and 5*b*, the same metal pins as those for forming the coil metal pins 4*a* and 4*b* can be used, whereby the manufacturing cost of the coil component 1*k* can be reduced in comparison with the coil component 1*g* of the sixth embodiment.

Tenth Embodiment

Figure 18:
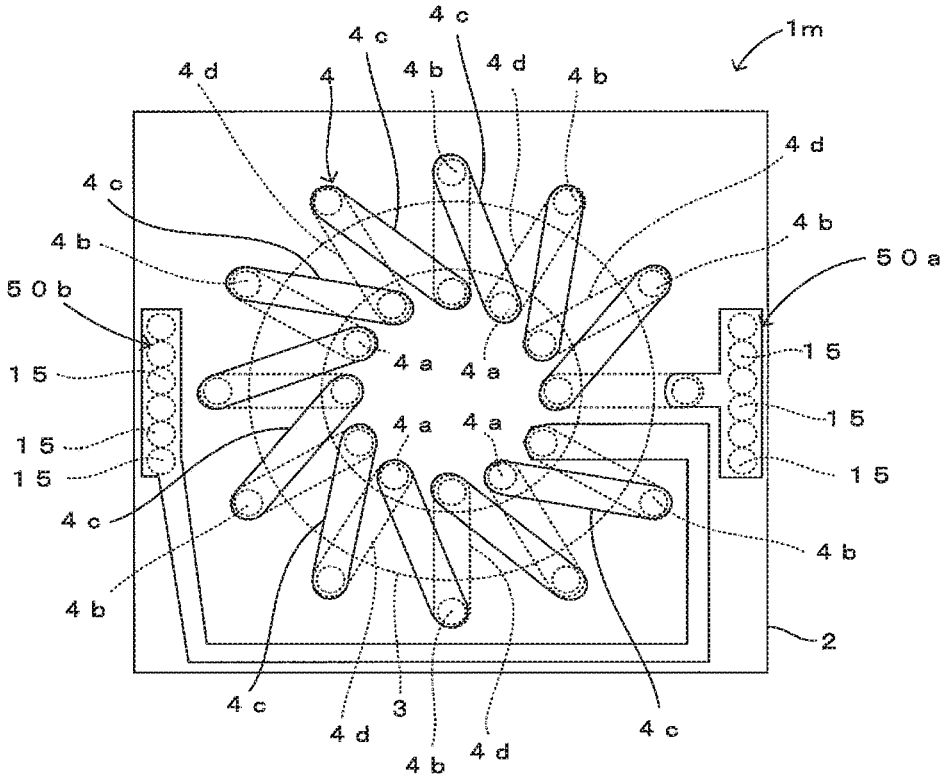
FIG. 18 is a plan view of a coil component according to a tenth embodiment of the present disclosure.

A coil component 1*m* according to a tenth embodiment of the present disclosure will be described with reference to FIGS. 18 and 19. FIG. 18 is a plan view of the coil component 1*m*, and FIG. 19 is a cross-sectional view of the coil component 1*m*.

Figure 19:
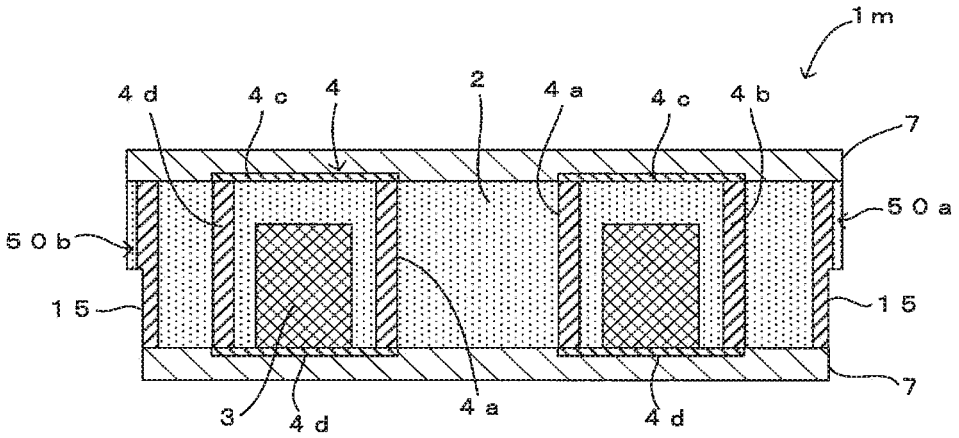
FIG. 19 is a cross-sectional view of the coil component in FIG. 18.

The coil component 1*m* according to the present embodiment differs from the coil component 1*k* of the ninth embodiment having been described with reference to FIGS. 16 and 17 in a point that, as shown in FIGS. 18 and 19, part of the circumference side surface of each of the input and output metal pins 5*a* and 5*b*, exposed in the coil component 1*k* of the above-described ninth embodiment, is covered with the resin of the insulation layer 2, and the lower end surface of each of the input and output metal pins 5*a* and 5*b* is covered with the covering insulation film 7. Because other constituent elements are the same as those of the coil component 1*k* of the ninth embodiment, the same reference signs are assigned thereto and description thereof will be omitted.

To be specific, in the coil component 1*k* of the above-described ninth embodiment, the input and output metal pins 5*a* and 5*b* are exposed, in their entirety in the lengthwise direction thereof (in the thickness direction of the insulation layer 2), from the side surface of the insulation layer 2. However, in the coil component 1*m* of this embodiment, part of each of the input and output metal pins 5*a* and 5*b* in the lengthwise direction (upper end portion side of the input and output metal pins 5*a* and 5*b*) is covered with the insulation layer 2.

According to this structure, in addition to the same effect as in the coil component 1*k* of the ninth embodiment discussed above, the connection portions between the input and output metal pins 5*a*, 5*b* and the upper side portion wiring electrode patterns 4*c* can be protected by the insulation layer 2. Further, in order to optimize the amount of solder used in connection with the exterior (adjustment of solder fillet extension), an area of the connection surface with the exterior can be adjusted as well. Note that in this case, the coil component 1*m* can be manufactured in the same manner as the coil component 1*h* having been discussed with reference to FIG. 11.

Eleventh Embodiment

Figure 20:
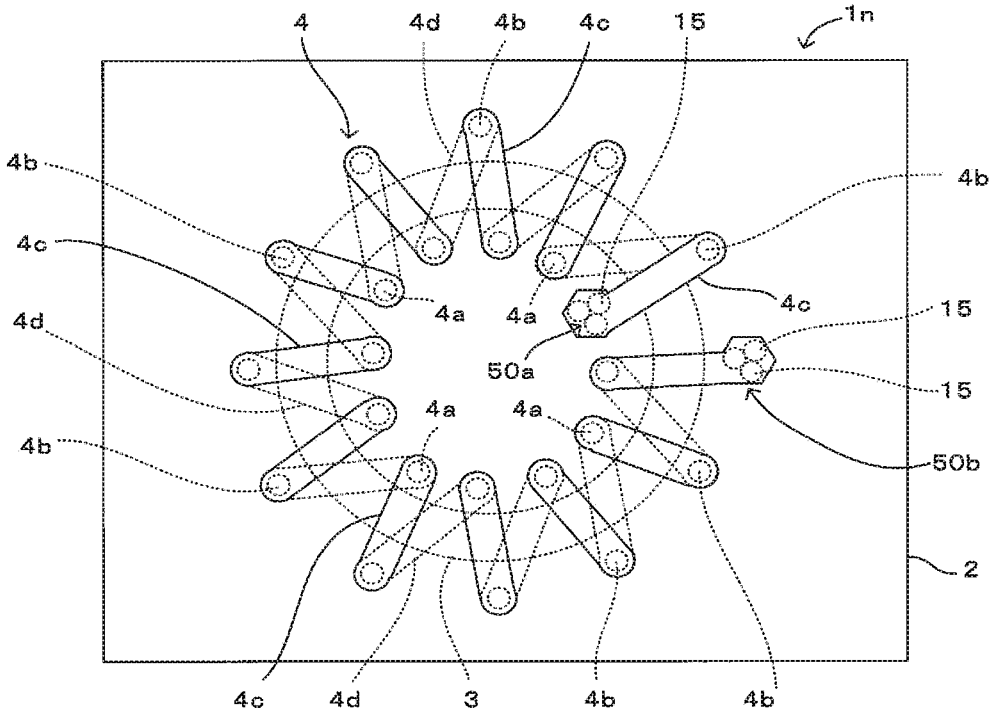
FIG. 20 is a plan view of a coil component according to an eleventh embodiment of the present disclosure.

A coil component 1*n* according to an eleventh embodiment of the present disclosure will be described with reference to FIG. 20. FIG. 20 is a plan view of the coil component 1*n*.

The coil component 1*n* according to the present embodiment differs from the coil component 1*a* of the first embodiment having been described with reference to FIG. 1 in a point that, as shown in FIG. 20, the input conductor (input metal pin 5*a*) is formed of the assemblage 50*a* of the plurality of input metal pins 5*a* having the same diameter size as the coil metal pins 4*a* and 4*b*, and the output conductor (output metal pin 5*b*) is formed of the assemblage 50*b* of the plurality of output metal pins 5*b* having the same diameter size as the coil metal pins 4*a* and 4*b*. Because other constituent elements are the same as those of the coil component 1*a* of the first embodiment, the same reference signs are assigned thereto and description thereof will be omitted.

According to this structure, as the metal pins for forming the input and output metal pins 5*a* and 5*b*, the same metal pins as those for forming the coil metal pins 4*a* and 4*b* can be used, whereby the same effect can be obtained as in the coil component 1*a* of the first embodiment and further the manufacturing cost of the coil component 1*n* can be reduced.

Twelfth Embodiment

Figure 21:
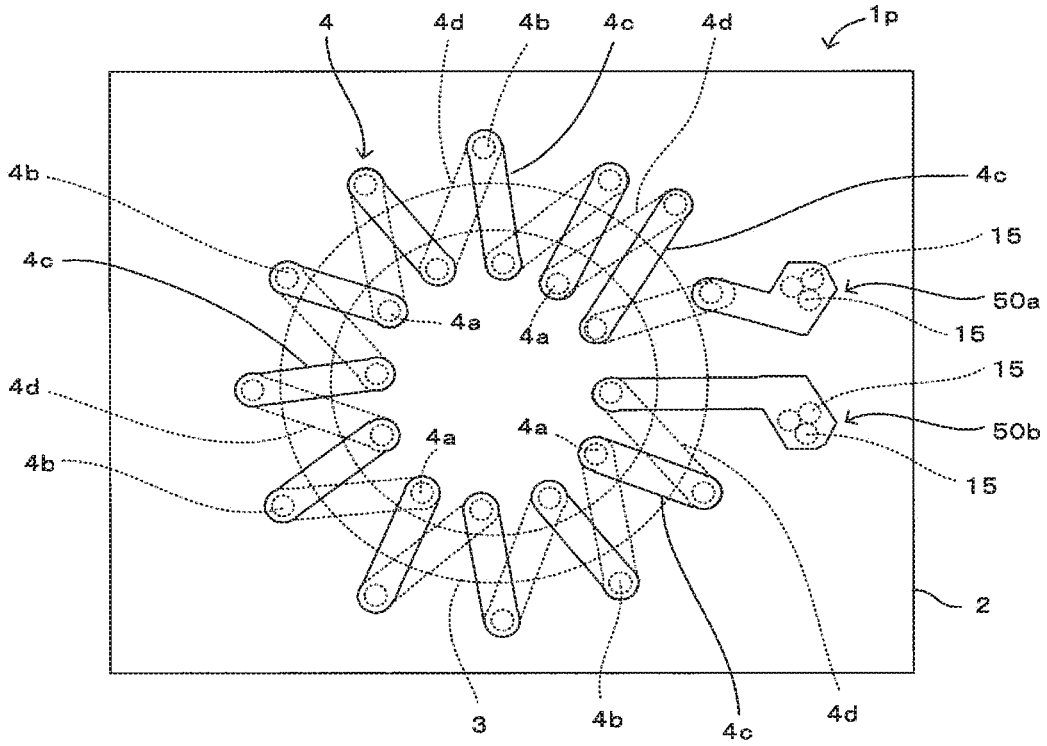
FIG. 21 is a plan view of a coil component according to a twelfth embodiment of the present disclosure.

A coil component 1*p* according to a twelfth embodiment of the present disclosure will be described with reference to FIG. 21. FIG. 21 is a plan view of the coil component 1*p*.

The coil component 1*p* according to the present embodiment differs from the coil component 1*b* of the second embodiment having been described with reference to FIG. 2 in a point that, as shown in FIG. 21, the input conductor (input metal pin 5*a*) is formed of the assemblage 50*a* of the plurality of input metal pins 5*a* having the same diameter size as the coil metal pins 4*a* and 4*b*, and the output conductor (output metal pin 5*b*) is formed of the assemblage 50*b* of the plurality of output metal pins 5*b* having the same diameter size as the coil metal pins 4*a* and 4*b*. Because other constituent elements are the same as those of the coil component 1*b* of the second embodiment, the same reference signs are assigned thereto and description thereof will be omitted.

According to this structure, as the metal pins for forming the input and output metal pins 5*a* and 5*b*, the same metal pins as those for forming the coil metal pins 4*a* and 4*b* can be used, whereby the same effect can be obtained as in the coil component 1*b* of the second embodiment and further the manufacturing cost of the coil component 1*p* can be reduced.

Thirteenth Embodiment

Figure 22:
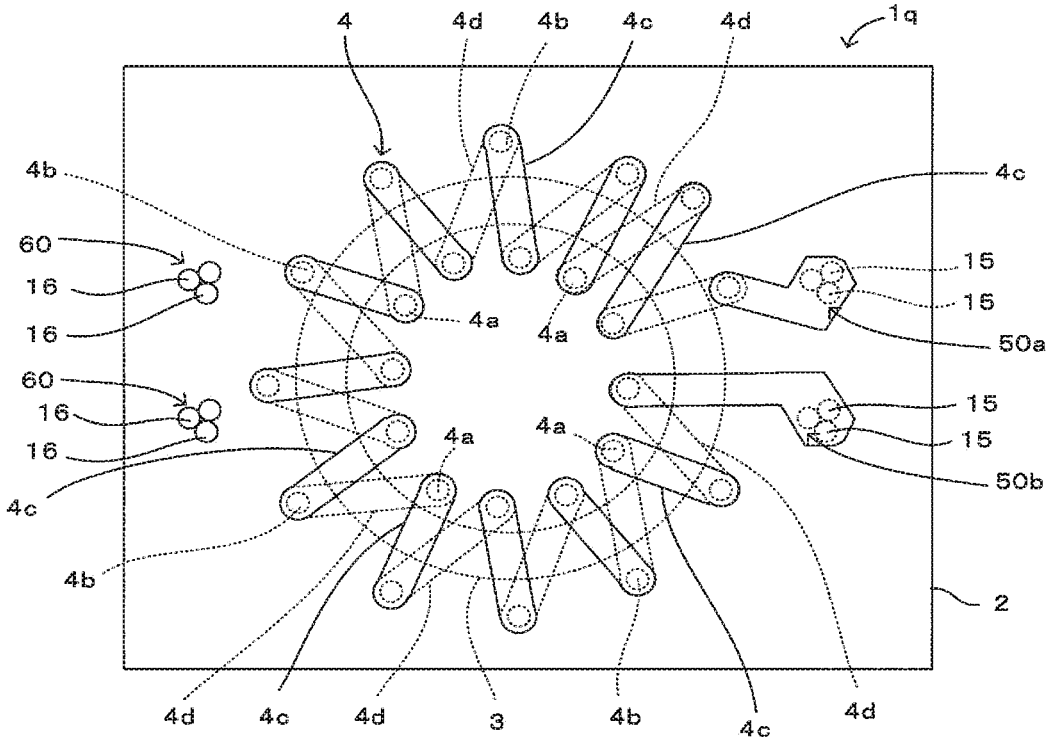
FIG. 22 is a plan view of a coil component according to a thirteenth embodiment of the present disclosure.

A coil component 1*q* according to a thirteenth embodiment of the present disclosure will be described with reference to FIG. 22. FIG. 22 is a plan view of the coil component 1*q*.

The coil component 1*q* according to the present embodiment differs from the coil component 1*c* of the third embodiment having been described with reference to FIG. 3 in a point that, as shown in FIG. 22, the input conductor (input metal pin 5*a*) is formed of the assemblage 50*a* of the plurality of input metal pins 5*a* having the same diameter size as the coil metal pins 4*a* and 4*b*, the output conductor (output metal pin 5*b*) is formed of the assemblage 50*b* of the plurality of output metal pins 5*b* having the same diameter size as the coil metal pins 4*a* and 4*b*, and each of the dummy metal pins 6 is formed of assemblage 60 of a plurality of dummy formation metal pins 16 having the same diameter size as the coil metal pins 4*a* and 4*b*. Because other constituent elements are the same as those of the coil component 1*c* of the third embodiment, the same reference signs are assigned thereto and description thereof will be omitted.

According to this structure, as the metal pins for forming the input and output metal pins 5*a*, 5*b* and the dummy formation metal pins 16, the same metal pins as those for forming the coil metal pins 4*a* and 4*b* can be used, whereby the same effect can be obtained as in the coil component 1*c* of the third embodiment and further the manufacturing cost of the coil component 1*q* can be reduced.

Fourteenth Embodiment

Figure 23:
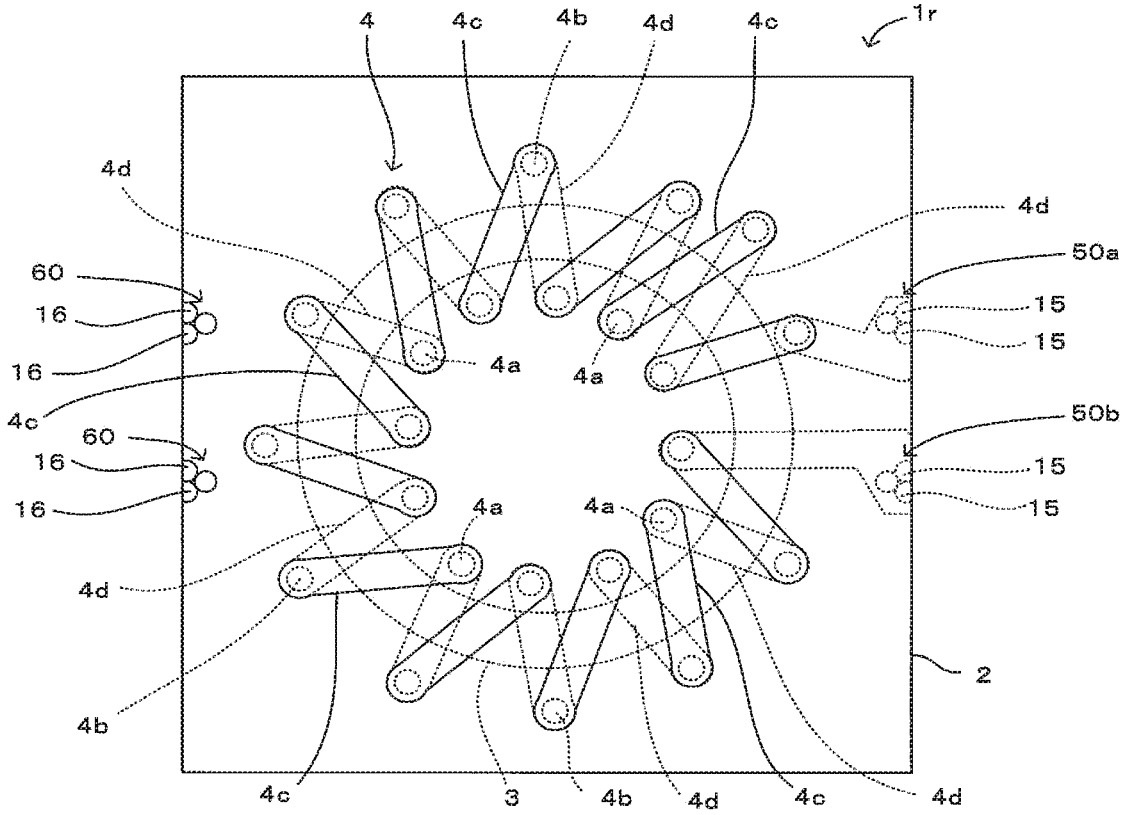
FIG. 23 is a plan view of a coil component according to a fourteenth embodiment of the present disclosure.

A coil component 1*r* according to a fourteenth embodiment of the present disclosure will be described with reference to FIG. 23. FIG. 23 is a plan view of the coil component 1*r*.

The coil component 1*r* according to the present embodiment differs from the coil component 1*d* of the fourth embodiment having been described with reference to FIG. 4 in a point that, as shown in FIG. 23, the input conductor (input metal pin 5*a*) is formed of the assemblage 50*a* of the plurality of input metal pins 5*a* having the same diameter size as the coil metal pins 4*a* and 4*b*, the output conductor (output metal pin 5*b*) is formed of the assemblage 50*b* of the plurality of output metal pins 5*b* having the same diameter size as the coil metal pins 4*a* and 4*b*, and each of the dummy metal pins 6 is formed of the assemblage 60 of the plurality of dummy formation metal pins 16 having the same diameter size as the coil metal pins 4*a* and 4*b*. Because other constituent elements are the same as those of the coil component 1*d* of the fourth embodiment, the same reference signs are assigned thereto and description thereof will be omitted.

According to this structure, as the metal pins for forming the input and output metal pins 5*a*, 5*b* and the dummy formation metal pins 16, the same metal pins as those for forming the coil metal pins 4*a* and 4*b* can be used, whereby the same effect can be obtained as in the coil component 1*d* of the fourth embodiment and further the manufacturing cost of the coil component 1*r* can be reduced.

It is to be noted that the present disclosure is not limited to the above-described embodiments, and a variety of modifications can be made in addition to those described above within the spirit and scope of the disclosure. For example, coil components may be formed by combining the structures of the above-described embodiments.

The magnetic body core 3 is not limited to a ring-shaped toroidal core; for example, as shown in FIGS. 24A through 24D, various types of cores of different shapes such as a rod-shaped magnetic body core 3*a* or the like can be used. FIGS. 24A through 24D are diagrams respectively illustrating variations on magnetic body cores; that is, plan views of coil components 1*s*, 1*t*, 1*u*, and 1*v*, in each of which the upper side portion wiring electrode patterns 4*c* and the lower side portion wiring electrode patterns 4*d* are omitted, are indicated.

Figure 24A:
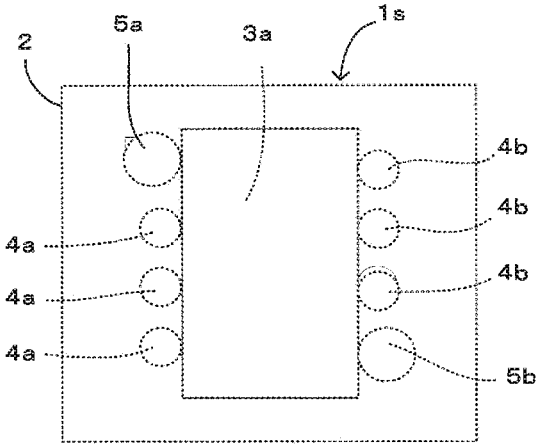
FIGS. 24A through 24D include diagrams illustrating variations on a magnetic body core.
Figure 24C:
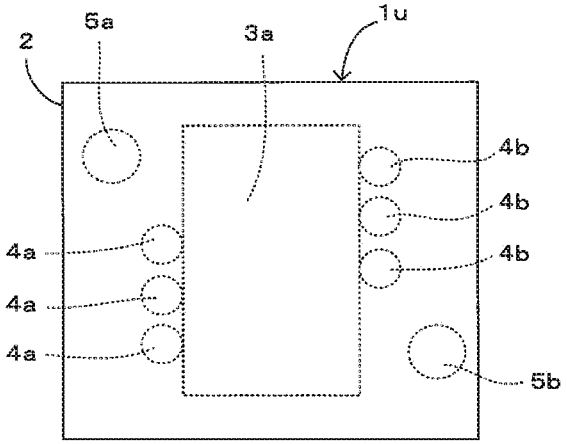
Figure 24B:
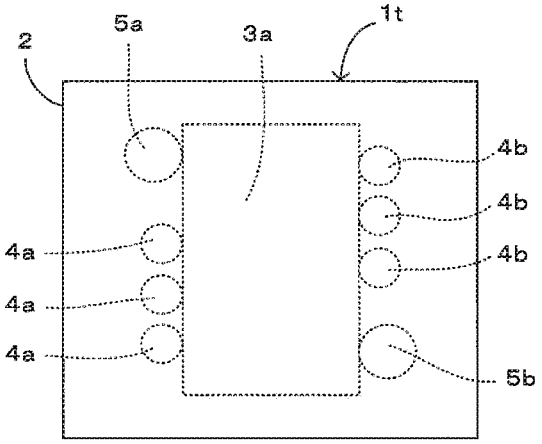
Figure 24D:
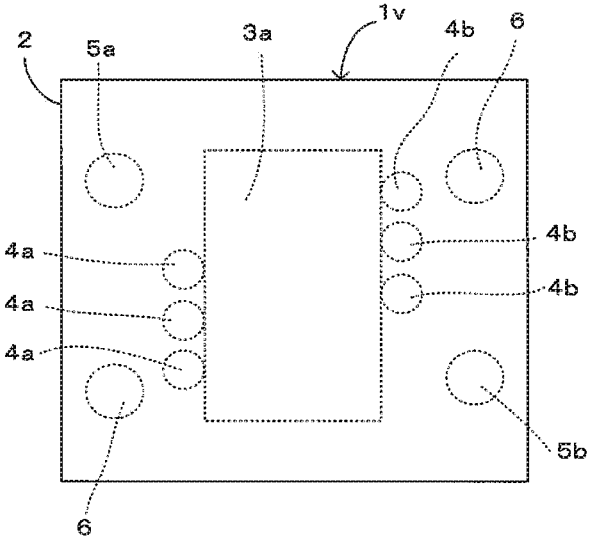
Figure 25:
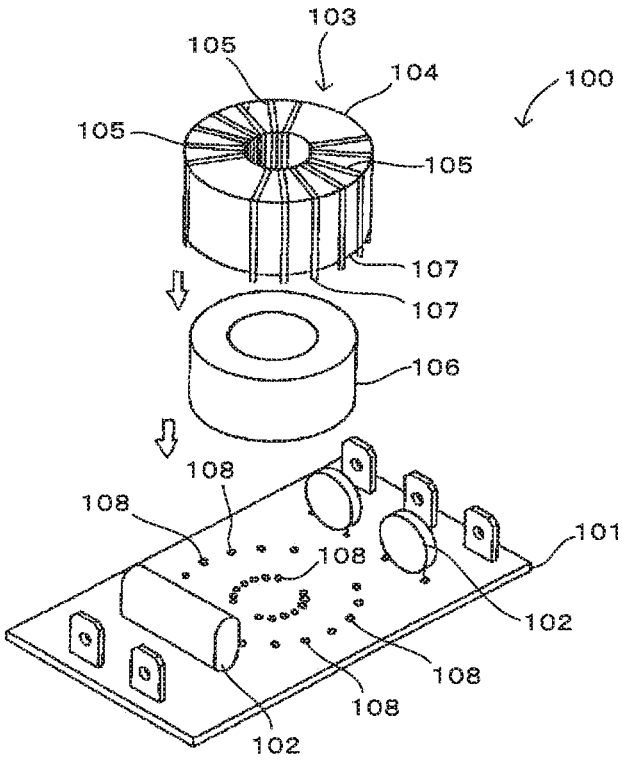
FIG. 25 is an exploded perspective view of a known module.

Here, FIG. 24A is a plan view of the coil component is in which the magnetic body core 3 of the coil component 1*a* of the above-described first embodiment (see FIG. 1) is constituted to be a rod-shaped one. FIG. 24B is a plan view of the coil component 1*t* in which a gap between the mutually adjacent input and output metal pins 5*a*, 5*b* and the coil metal pins 4*a*, 4*b* of the coil component is shown in FIG. 24A is so formed as to be wider than a gap between the mutually adjacent coil metal pins 4*a* and 4*b*. FIG. 24C is a plan view of the coil component 1*u* in which the magnetic body core 3 of the coil component 1*b* of the above-described second embodiment (see FIG. 2) is constituted to be a rod-shaped one. FIG. 24D is a plan view of the coil component 1*v* in which the magnetic body core 3 of the coil component 1*c* of the above-described third embodiment (see FIG. 3) is constituted to be a rod-shaped one.

The number of the input and output metal pins 5*a* and 5*b*, and the number of the dummy metal pins 6 can be appropriately changed.

In the eighth through fourteenth embodiments discussed above, although the case in which both the input conductor and the output conductor are respectively constituted of the assemblage 50*a* and assemblage 50*b* of the input metal pins 5*a* or the output metal pins 5*b* is described, only one of them may be formed of the assemblage of the input metal pins 5*a* or the output metal pins 5*b*.

Further, in the eighth through fourteenth embodiments discussed above, although the case where the assemblage 50*a* and assemblage 50*b* are respectively formed in a state of the mutually adjacent input metal pins 5*a* making contact with each other or the mutually adjacent output metal pins 5*b* making contact with each other is described, it is not absolutely necessary for the stated metal pins to make contact with each other and there may be a space between the mutually adjacent input metal pins 5*a* or between the mutually adjacent output metal pins 5*b*. A cross-section area of each of the input and output conductors in this case is a sum total of cross-section areas of the input metal pins 5*a* or a sum total of cross-section areas of the output metal pins 5*b*.

The present disclosure can be widely applied to various types of coil components including an insulation layer in which a coil core is embedded and a coil electrode wound around the above coil core.

1*a*-1*k*, 1*m*, 1*n*, 1*p*-1*v* COIL COMPONENT
2 INSULATION LAYER
3, 3*a* MAGNETIC BODY CORE (COIL CORE)
4, 8*a*, 8*b* COIL ELECTRODE
4*a* INNER SIDE PORTION METAL PIN (COIL METAL PIN)
4*b* OUTER SIDE PORTION METAL PIN (COIL METAL PIN)
5*a* INPUT METAL PIN (INPUT CONDUCTOR)
5*b* OUTPUT METAL PIN (OUTPUT CONDUCTOR)
6 DUMMY METAL PIN
50*a* ASSEMBLAGE (INPUT CONDUCTOR)
50*b* ASSEMBLAGE (OUTPUT CONDUCTOR)

The invention claimed is:

1. A coil component comprising:
an insulation layer having a coil core embedded therein;
a coil electrode wound around the coil core;
an input conductor having at least one input metal pin and embedded in the insulation layer, wherein a part of the input conductor is exposed; and
an output conductor having at least one output metal pin and embedded in the insulation layer, wherein a part of the output conductor is exposed,
wherein the coil electrode includes a plurality of coil metal pins arranged around the coil core, and wherein the plurality of coil metal pins are provided upright in a thickness direction of the insulation layer;
wherein the input metal pin and the output metal pin are provided upright in the thickness direction of the insulation layer, and at least one of a part of a circumference side surface and one end surface of each of the input and output metal pins is exposed from the insulation layer;
at least one of cross-section areas of the input conductor and the output conductor is wider than a cross-section area of the coil metal pin; and
wherein a length of the input conductor and a length of the output conductor are shorter than a length of the coil metal pin.

2. The coil component according to claim 1,
wherein the input conductor comprises the single input metal pin,
the output conductor comprises the single output metal pin, and
at least one of the input metal pin and the output metal pin has a larger diameter than each of the coil metal pins.

3. The coil component according to claim 1,
wherein at least one of the input conductor and the output conductor is an assemblage of a plurality of the input metal pins or the output metal pins having a same diameter size as the coil metal pins, and
at least one of a part of a circumference side surface and one end surface of the assemblage is exposed from the insulation layer.

4. The coil component according to claim 1,
wherein a gap between at least one of the input and output conductors and each adjacent one of the coil metal pins is wider than a gap between mutually adjacent ones of the coil metal pins.

5. The coil component according to claim 1,
wherein at least one of the input conductor and the output conductor is arranged in a position further distanced from the coil core than each of the coil metal pins.

6. The coil component according to claim 1, further comprising:
a dummy metal pin for external connection provided upright in the thickness direction of the insulation layer.

7. The coil component according to claim 6,
wherein the dummy metal pin is arranged in a position point-symmetric in a plan view relative to one of the input and output conductors while taking a center of the insulation layer as a center of the symmetry.

8. The coil component according to claim 6,
wherein the part of the input conductor and the part of the output conductor are exposed from a circumference side surface of the insulation layer, and
a part of a circumference side surface of the dummy metal pin is also exposed from the circumference side surface of the insulation layer.

9. The coil component according to claim 8,
wherein a length of the dummy metal pin is shorter than the length of the coil metal pin.

10. The coil component according to claim 2,
wherein a shape of the insulation layer in a plan view, a shape of a cross-section of the input metal pin, and a shape of a cross-section of the output metal pin are rectangular, and
each of side surfaces of the input metal pin and the output metal pin exposed from the insulation layer is in a same plane as a side surface of the insulation layer.

11. The coil component according to claim 3,
wherein a shape of the insulation layer is rectangular in a plan view,
the input or output metal pins included in the assemblage are aligned along a predetermined side of the insulation layer, and
a part of the circumference side surface of each of the input metal pins or a part of the circumference side surface of each of the output metal pins is exposed from the side surface of the insulation layer as a portion of the assemblage exposed from the insulation layer.

12. The coil component according to claim 2,
wherein a gap between at least one of the input and output conductors and each adjacent one of the coil metal pins is wider than a gap between mutually adjacent ones of the coil metal pins.

13. The coil component according to claim 3,
wherein a gap between at least one of the input and output conductors and each adjacent one of the coil metal pins is wider than a gap between mutually adjacent ones of the coil metal pins.

14. The coil component according to claim 2, wherein at least one of the input conductor and the output conductor is arranged in a position further distanced from the coil core than each of the coil metal pins.

15. The coil component according to claim 3, wherein at least one of the input conductor and the output conductor is arranged in a position further distanced from the coil core than each of the coil metal pins.

16. The coil component according to claim 4, wherein at least one of the input conductor and the output conductor is arranged in a position further distanced from the coil core than each of the coil metal pins.

17. The coil component according to claim 2, further comprising:

a dummy metal pin for external connection provided upright in the thickness direction of the insulation layer.

18. The coil component according to claim 3, further comprising:

a dummy metal pin for external connection provided upright in the thickness direction of the insulation layer.

19. The coil component according to claim 4, further comprising:

a dummy metal pin for external connection provided upright in the thickness direction of the insulation layer.

20. The coil component according to claim 5, further comprising:

a dummy metal pin for external connection provided upright in the thickness direction of the insulation layer.

21. The coil component according to claim 1, wherein the length of the input conductor and the length of the output conductor are shorter than a thickness of the insulating layer in the thickness direction.

* * * * *